United States Patent [19]

Dudczak et al.

[11] Patent Number: 4,914,696

[45] Date of Patent: Apr. 3, 1990

[54] COMMUNICATIONS SYSTEM WITH TANDEM SCRAMBLING DEVICES

[75] Inventors: Cary M. Dudczak; Mark W. McGuire, both of Hoffman Estates, Ill.; David T. Tennant, Gary, Ind.

[73] Assignee: Motorola, Inc., Schaumburg, Ill.

[21] Appl. No.: 232,265

[22] Filed: Aug. 15, 1988

[51] Int. Cl.[4] ..... H04K 1/04

[52] U.S. Cl. ..... 380/21; 380/38; 380/47; 380/48; 380/49

[58] Field of Search ..... 380/9, 21, 23, 24, 25, 380/49, 50, 43–47, 38, 39, 34, 48; 340/825.52

[56] References Cited

U.S. PATENT DOCUMENTS

| | | | |
|---|---|---|---|
| 4,182,933 | 1/1980 | Rosenblum | 380/21 |
| 4,228,321 | 10/1980 | Flanagan | 380/21 |
| 4,349,695 | 9/1982 | Morgan et al. | 380/25 |
| 4,392,021 | 7/1983 | Slate | 380/11 |
| 4,411,017 | 10/1983 | Talbot | 380/31 |
| 4,433,211 | 2/1984 | McCalmont et al. | 380/36 |
| 4,449,247 | 5/1984 | Waschka, Jr. | 380/49 X |
| 4,549,308 | 10/1985 | LoPinto | 380/21 |
| 4,555,805 | 11/1985 | Talbot | 380/33 |
| 4,578,532 | 3/1986 | Markwitz | 380/21 |
| 4,638,298 | 1/1987 | Spiro | 340/825.52 X |
| 4,815,128 | 3/1989 | Malek | 380/9 |
| 4,827,507 | 5/1989 | Marry et al. | 380/38 |

OTHER PUBLICATIONS

Datotek, Inc.: Product Data Sheet 9-78-1550HM, "Encryption DVP-810".

Datotek, Inc.: Product Data Sheet 12-78-1000SE, "Encryption DV-505/TDS".

Datotek, Inc.: Product Data Sheet (4/78), -2500-MP, "Model DV-505 Voice Security System", 1977.

*Primary Examiner*—Stephen C. Buczinski

*Assistant Examiner*—Bernarr Earl Gregory

*Attorney, Agent, or Firm*—Raymond A. Jenski; Rolland R. Hackbart

[57] ABSTRACT

An intermediate scrambling device for a radiotelephone system is disclosed by which it is possible to establish and maintain scrambled communications between an originating scrambler terminal and the most distant companion scrambler on the circuit. The intermediate scrambler may establish and maintain the scrambled communications if it is the most distant scrambler, or it may become transparent to a more distant scrambler.

17 Claims, 20 Drawing Sheets

—PRIOR ART—

2/20

300
301
302
303
304
305
307
308
309
311
313
314
315
317
318
321
323
325
331
350
RADIO TELEPHONE SUBSCRIBER TRANSCEIVER
RECEIVER SCRAMBLER
RADIO TELEPHONE SUBSCRIBER TRANSCEIVER
FIXED RADIO TELEPHONE TRANSCEIVER
DM-SCRAMBLER
DM-SCRAMBLER
DM-SCRAMBLER
DM-SCRAMBLER
RADIO TELEPHONE SWITCHING NETWORK
X-SCRAMBLER
X-SCRAMBLER
LAND TELEPHONE SWITCHING NETWORK
FIXED RADIO TELEPHONE TRANSCEIVER

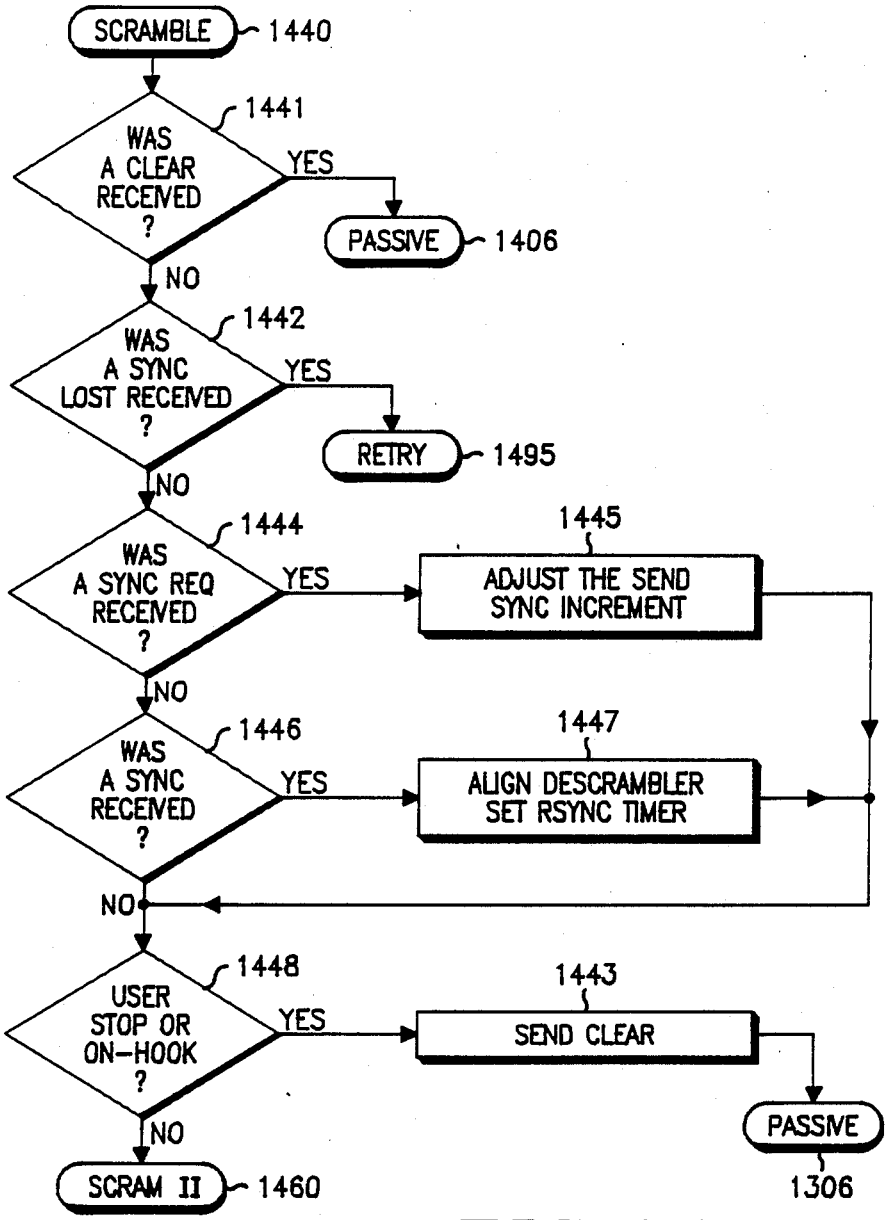
FIG. 14c
FIG. 6
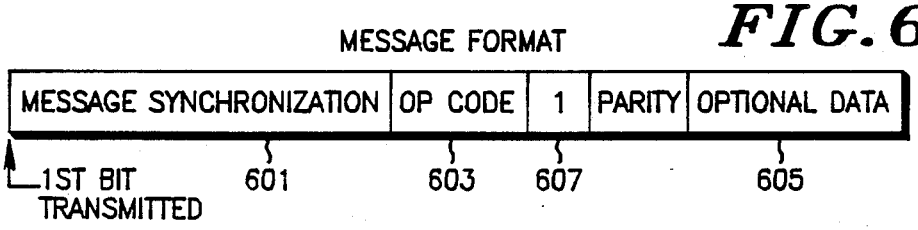

20/20

COMMUNICATIONS SYSTEM WITH TANDEM SCRAMBLING DEVICES

BACKGROUND OF THE INVENTION

This invention relates generally to the control of scrambling or encrypting of all or part of a duplex telecommunications circuit, and more particularly to the control of analog voice band scramblers over a total telecommunications circuit having tandem duplex links (or over as much of the total circuit as equipped). The system upon establishment of a communications link, will automatically configure the scramblers for a data exchange between end users.

Modern duplex telecommunications circuits (Circuits), whether voice or data, are often composed of multiple duplex telecommunications links (Links) connected in tandem. Some of these Links are particularly vulnerable to eavesdropping, compromising the privacy of the user. While end-to-end speech scrambling and data encrypting may be ultimate goals, a practical approach may generally start with the more vulnerable Links of a Circuit and grow gradually into an end-to-end secure Circuit. For example, a radiotelephone system is particularly vulnerable to eavesdropping. It would be advantageous, therefore, to scramble or encrypt the radio Link portion of a telephone Circuit first and add wireline protection later. This initial solution for the radio Link imposes the need for a companion scrambler/descrambler within the radiotelephone system's land infrastructure or at the system's telephone network interfacing. It is further desirable that when the far-end subscriber also becomes equipped with a companion terminal scrambler/descrambler, the entire Circuit be scrambled or encrypted.

Terminal scrambler/descramblers have been previously employed in several ways for scrambling the radio Link. The simplest adaptation requires both the radiotelephone subscriber station and the far-end subscriber station to be suitably equipped, and end-to-end protection is provided. This has been done with conventional analog voice band scramblers applied in a conventional way. It has also been done using digital scramblers. An example of this form of adaptation is provided by U.S. Pat. No. 4,815,128 assigned to the assignee of the present invention. Typically, the intermediate equipment placed at the interconnection point between the radio system and the telephone network receives an encoded signal from either the radio system or the telephone network and modifies and/or repeats the signal to the other.

In some applications, this additional processing of the encoded signal further corrupts the signal quality. One such application is that of limited bandwidth analog scrambling further described in U.S. Pat. No. 4,827,507 assigned to the assignee of the present invention.

Conventional terminal scramblers have also been adapted to radiotelephone service by inserting one in tandem in the Circuit that connects the radiotelephone system to the land network. This effectively secures the radio Link for those radiotelephone subscribers so equipped but offers no assistance in, and usually complicates, end-to-end scrambling.

Since the previous implementations envisioned either end-to-end or radio Link scrambling, but not both, there exists a need for a new and unique privacy scrambling system which will scramble the radio Link for radiotelephone subscribers equipped with terminal scramblers and yet provide end-to-end scrambling on calls in which the far-end subscriber is similarly equipped.

SUMMARY OF THE INVENTION

Therefore, it is one object of the present invention to provide a duplex scrambler/descrambler system in which scrambling can be applied over the greatest possible fraction of a Circuit composed of multiple Links.

It is another object of the present invention to detect the presence of more than one companion scrambler/descrambler and to automatically disable that companion scrambler/descrambler which is intermediate the originating terminal scrambler/descrambler and the most distant companion scrambler/descrambler.

It is a further object of the present invention to provide in a Circuit equipped with at least one suitable terminal and one or more companion tandem scrambler/descrambler, means by which duplex data communications is established and maintained between that terminal scrambler and a far-end companion terminal, if present, otherwise the most distant of companion tandem scrambler/descrambler, with intermediate tandem scrambler/descramblers providing Circuit continuity.

Accordingly, these and other objects are encompassed in the present invention which comprises the method and apparatus for establishing scrambled communications on a communications circuit which utilizes at least two communications links and has an originating scrambling terminal an answering scrambling terminal and at least one intermediate scrambler. A first data message is sent from the originating scrambling terminal and detected at both the intermediate scrambler and the answering scrambling terminal. A determination is made whether the answering scrambling terminal has sent a second data message in response to the first data message. If the answering scrambling terminal has sent the second data message, the intermediate scrambler is placed in a transparent, non-scrambling mode.

BRIEF DESCRIPTION OF THE DRAWINGS

FIG. 6 is a diagram of a message format which may be employed by the present invention.

FIGS. 13 and 14A through 14E are a flowchart of the message handling processes of a terminal scrambler that may be employed in the present invention.

DESCRIPTION OF THE PREFERRED EMBODIMENT

Figure 1:
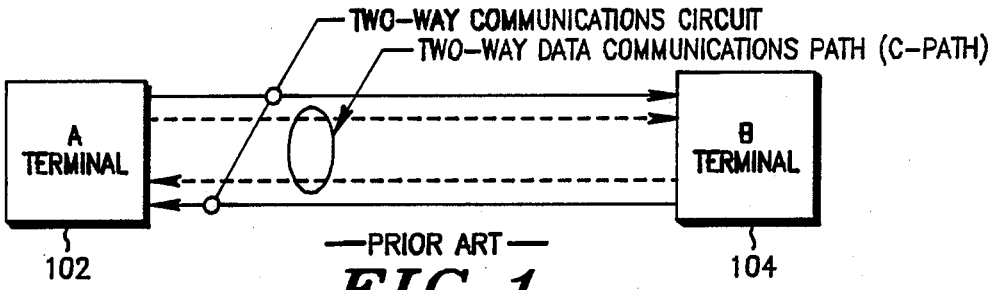
FIG. 1 is a representation of a conventional technique for establishment of two-way data communications between two terminal data devices.

Numerous protocols exist by which two terminals A and B at opposite ends of a circuit (102 and 104 shown in FIG. 1), can establish and maintain a two-way data communications path (herein called a C-path) between one another via which terminals A and B may exchange synchronizing and control messages. It is anticipated that either terminal A or terminal B may assume an "originating" terminal role while the other will assume a "terminating" role. Originate/answer modems with appropriate terminal equipment, connected to the public switched telephone network provide an appropriate example.

The synchronizing and controlling C-path of the present invention does not require full use of the Circuit; it may time- or frequency-share the circuit in different ways depending on its application. In an application in which the terminals are devices which scramble or encrypt messages, both the establishment and maintenance of a C-path is a prerequisite to duplex scrambled mode operation. Once established, the C-path time shares its portion of the Circuit with duplex scrambled speech; that portion of the Circuit without C-path carries duplex unscrambled (clear) speech. Terminals equipped with operative scramblers are hereinafter generally called X-Scramblers if the location is nonspecific and RX-Scramblers if they are specifically radiotelephone terminals. On calls in either direction between two X-Scramblers, the speech in both directions is scrambled after a C-path is established and so long as the C-path is maintained.

Figure 2A:
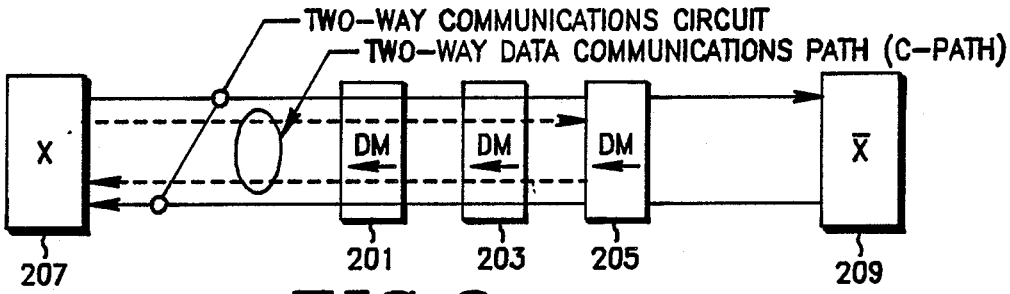
FIG. 2*a* illustrates the ability of the most distant of the directional tandem scramblers of the present invention to establish and maintain two-way data communications (a C-path) and provide scrambling while closer directional tandem scramblers only provide circuit continuity.
Figure 2B:
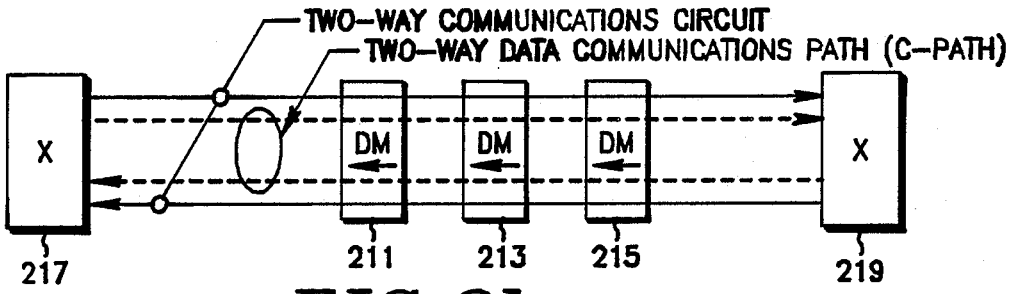
FIG. 2*b* illustrates directional tandem scramblers of the present invention which maintain only circuit continuity when both ends of the circuit are provided with companion scramblers.
Figure 2C:
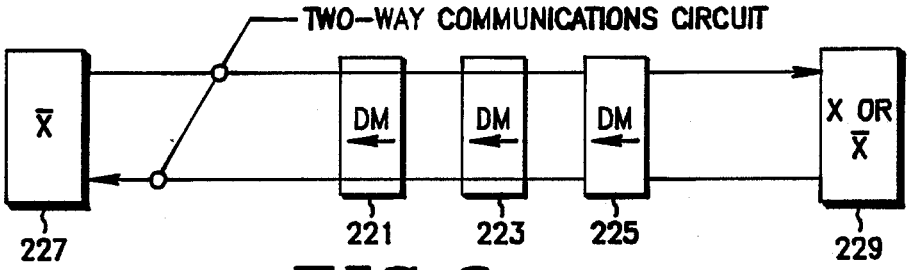
FIG. 2*c* illustrates an example when the directional tandem scramblers of the present invention will not establish and maintain two-way data communications and scrambling.

An analysis of a generalized communications Circuit can be made from FIGS. 2*a* through 2*c*. The communications Circuit can include a radiotelephone. The communications Circuit can also employ one or more directional intermediate scramblers (DM-Scramblers) in tandem with calls to or from an X-Scrambler or RX-Scrambler. As depicted in FIG. 2*a*, three DM-Scramblers (201, 203, and 205) may interface with an X-Scrambler (or RX-Scrambler) 207 to provide the C-path but it is a feature of the present invention that the scrambler yielding the longest scrambled path (i.e. X-Scrambler 207 to DM-Scrambler 205 in FIG. 2*a*) be the scrambler completing the C-path. It is a further feature of the present invention that a DM-Scrambler not interface and establish a C-path with a second DM-Scrambler but only with an X-Scrambler or an RX-Scrambler. A DM-Scrambler is said to "face" the X-Scrambler or RX-Scrambler with which it will establish a C-path. When a DM-Scrambler faces an RX-Scrambler, the duplex speech of that specific radio link is scrambled, regardless of the distant termination so that, like FIG. 2*a*, the terminating equipment 209 need not be a scrambler. On an RX-Scrambler to RX-Scrambler call, the radiotelephone system may or may not impose DM-Scramblers facing either or both, but will never impose DM-Scramblers so that they face each other.

In the preferred embodiment of the present invention, the DM-Scramblers have the following properties:

(1) As FIG. 2*a* illustrates, when the DM-Scramblers 201, 203, and 205 face an X-Scrambler or RX-Scrambler (207), a C-path (and two-way speech scrambling for the two-way communications Circuit) is established and maintained between the most distant DM-Scrambler 205 from the X-Scrambler 207 it faces; the other DM-Scramblers provide only circuit continuity.

(2) As FIG. 2*b* illustrates, when X-Scramblers (or RX-Scramblers) 217 and 219 are provided at both ends of the circuit, DM-Scramblers 211, 213 and 215 provide continuity to the Circuit so that a C-path is established and maintained directly between the X-Scramblers.

(3) As FIG. 2*c* illustrates, when DM-Scramblers 221, 223, and 225 face in the direction of any termination 227 other than an X-Scrambler, they only provide circuit continuity. A DM-Scrambler will not participate in a C-path with a scrambler that it does not face, such as if termination 229 is provided with an X-Scrambler.

(4) Given a C-path between an X-Scrambler 207 and a DM-Scrambler 205 as in FIG. 2*a*, if the other termination 209, by external intervention, becomes an X-Scrambler, then the C-path of the present invention automatically reconfigures and all the DM-Scramblers become transparent and provide circuit continuity with a C-path between the X-Scramblers, as in FIG. 2*b*.

It is a feature of the present invention that the X-Scramblers provide an indication, either visually or audibly, as to whether no C-path has been established from its end, or a C-path has been established with a DM-Scrambler, or a C-path has been established with an X-Scrambler.

Figure 3:
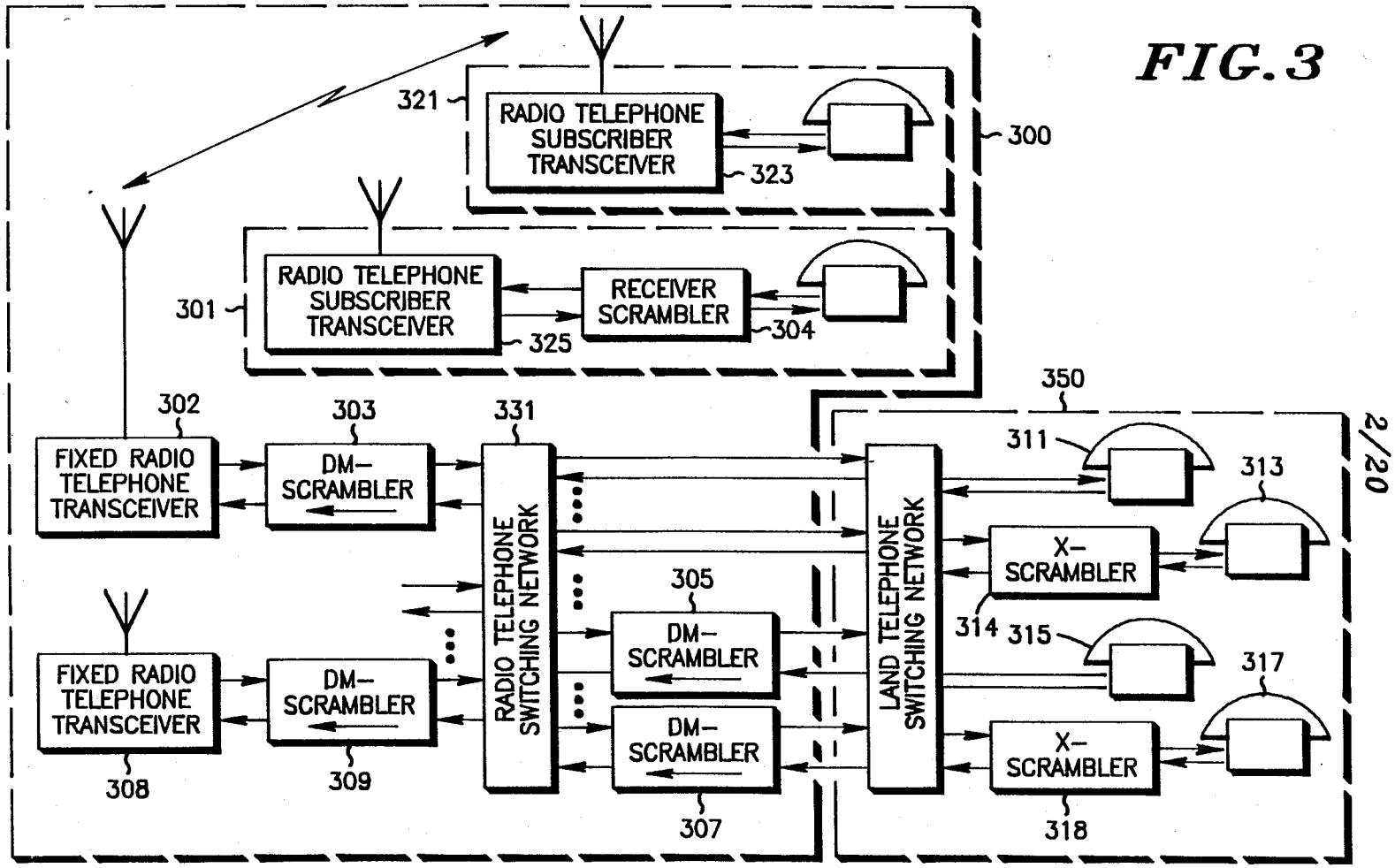
FIG. 3 is a block diagram of a radiotelephone system interconnected with a land telephone network and which may employ the present invention.

A more specific implementation is illustrated for the radiotelephone system 300 of FIG. 3. Since it is advantageous to be able to scramble or encrypt at least the radio Link portion of a telephone Circuit for those subscribers equipped with RX-Scramblers 304, but the entire Circuit if the far-end 301 subscriber is equipped with an X-X-Scrambler, there are several possibilities, a few of which are depicted in FIG. 3. For a connection with far-end subscriber 311 in the land telephone network 350 through fixed radiotelephone transceiver 302, the DM-Scrambler 303 will provide radio Link protection. For a connection with far-end subscriber 313, DM-Scrambler 303 must be "transparent" so that the far-end subscriber's X-Scrambler 314 will provide end-to-end scrambling. For a connection with far-end subscriber 315, through a vulnerable circuit (such as a microwave link, not shown) in the radiotelephone switching network 331, DM-Scrambler 305 will provide protection for the radio Link and the radiotelephone switching network Link, but scrambler 303 must be transparent. For a connection with far-end subscriber 317, which is also equipped with an X-Scrambler 318, both DM-Scramblers 303 and 307 must be transparent. In any Circuit between a land subscriber and a radiotelephone subscriber 321 who has no scrambling equipment, the DM-Scramblers must be transparent. In any Circuit between two RX-Scrambler equipped subscribers such as subscriber 301, the DM-Scramblers 303 and 309 via their respective fixed radiotelephone transceivers 302 and 308 will remain transparent. In a Circuit between an X-Scrambler equipped station 301 using fixed radiotelephone transceiver 302 and a non-equipped station 321 using fixed radiotelephone transceiver 308, the radio Link via fixed radiotelephone transceiver 302 will operate secure.

A radiotelephone system which may employ the present invention is that commonly known as a cellular system. In one conventional implementation of a cellular system, the fixed radiotelepone transceivers 302 and 308 may be those described in Motorola Instruction Manual No. 68P81060E30 published by Motorola Service Publications, Schaumburg, Ill. A radiotelephone subscriber transceiver 323 and 325 may be a model no. F19ZEA8439BA manufactured by Motorola, Inc. A radiotelephone switching network 331 may be similar to those shown and described in U.S. Pat. Nos. 3,746,915; 3,819,872; 3,906,166; and 4,268,722.

Figure 4:
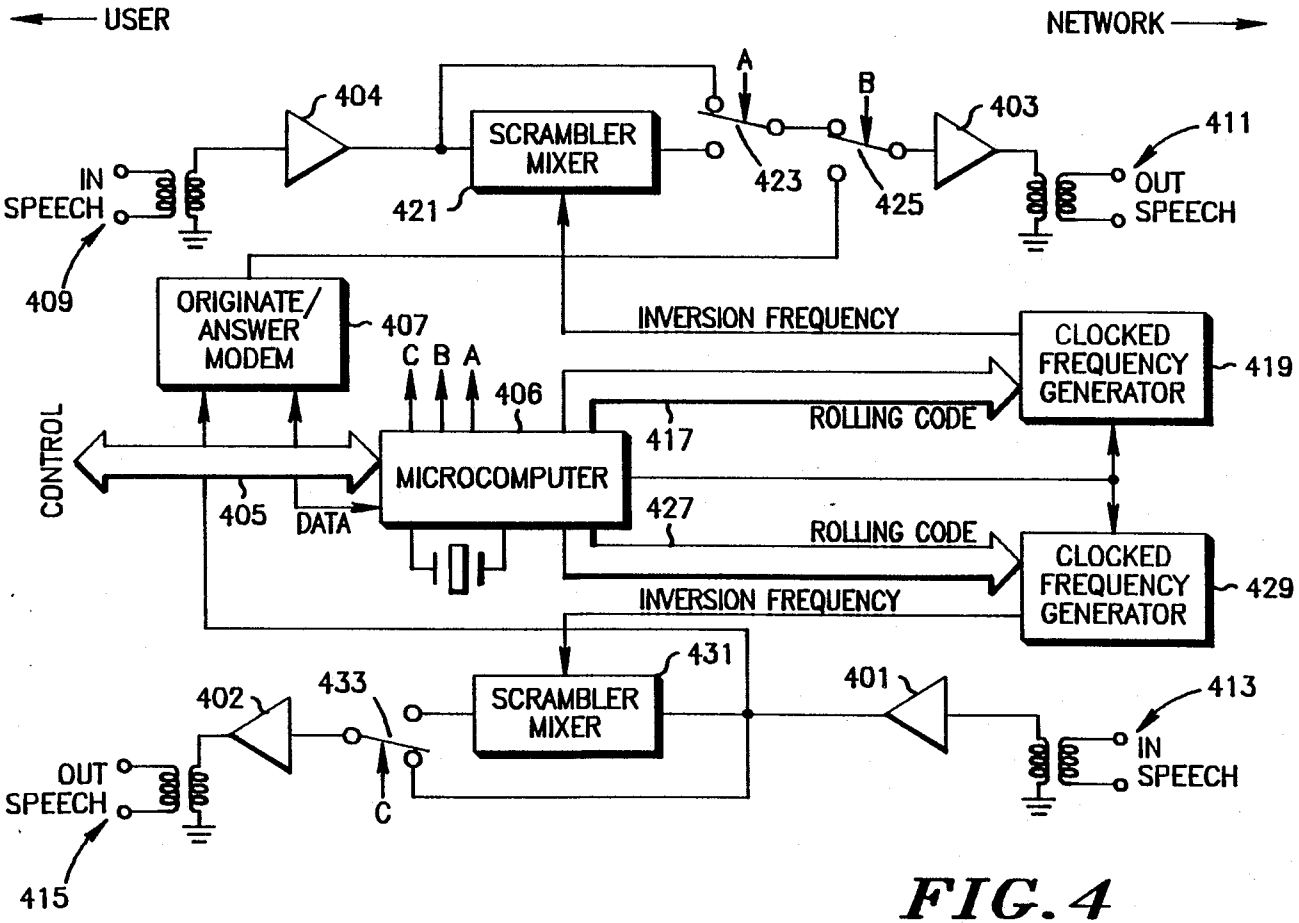
FIG. 4 is a block diagram of a terminal scrambler of which may utilize the present invention.

First, the establishing and maintaining of a C-path between an X-Scrambler and a companion X-Scrambler is described. FIG. 4 shows a functional block diagram of an X-Scrambler that is compatible with use in the present invention; it is a four-wire device with conventional gain and padding from amplifiers 401, 402, 403 and 404 to provide proper internal and external audio power levels and impedance. In addition to network and user in- and out-speech paths there are four user interface control commands (Hook, Orig/Term, Start and Stop) and three user status indicators (Clear, Partial Scrambled and Total Scrambled) which are communicated on the control bus 405 to a microcomputer 406. Modem 407 is an originate/answer modem such as a National Semiconductor MM74HC943, the modem being under control of the microcomputer 406, which may be an 8-bit microprocessor such as a Motorola type MC6805 or equivalent. In the originate mode, the X-Scrambler conventionally sends a Band A ("Mark" at 2225 Hz and "Space" at 2025 Hz) and listens to a Band B ("Mark" at 1270 Hz and "Space" at 1070 Hz); in the answer mode these bands are reversed.

Microcomputer 406 is crystal controlled so as to be able to operate with precise timing for both the C-path signaling as well as control of the scrambling and descrambling functions. In the preferred embodiment, the scrambling technique is that of a duplex multiple hop frequency inversion scrambling, but the invention need not be so limited. A duplex analog scrambler which may be utilized in the X-Scrambler or the RX-Scrambler is described in U.S. Pat. No. 4,827,507.

In the preferred embodiment, the scrambling and descrambling functions are controlled by microcomputer 406 Two essentially independent audio paths traverse the scrambler shown in FIG. 4. A first path accepts clear audio from the user in-speech port 409, frequency inverts the clear audio signal with one of a plurality of inversion frequencies for a given period of time before switching to another one of the plurality of inversion frequencies, and passes the rolling frequency inverted scrambled signal to the out-speech port 411 toward the network. A second path accepts a rolling frequency inverted scrambled signal from the network in-speech port 413, reinverts the scrambled signal, and applies the now clear audio to the user out-speech port 415.

The C-path is set up by the originating or terminating scrambler which creates a rolling code pattern of the plurality of inversion frequencies and conveys the pattern to the distant scrambler. In a full duplex system the pattern may be different in each direction of the channel.

Referring again to FIG. 4, the microcomputer 406 is clocked by a crystal controlled oscillator to derive a frequency stable clock for inversion frequency stability and code synchronization The microcomputer 406 and its internal associated memory performs the functions of: (a) continuously generating a random seed number for use in creating a rolling code starting number for the user in-speech path; (b) generating a user in-speech path rolling code starting point binary number; (c) generating a network in speech path rolling code binary starting point number; (d) updating and outputting the user in speech path rolling code and updating and outputting the rolling code while maintaining synchronization with the rolling codes at the far end receiving scrambler; and (e) controlling the muting and bypass functions of the scrambler.

A sample of the user in-speech path rolling code is output from microcomputer 406 on bus 417 to a clocked frequency generator 419. The clocked frequency generator 419 converts the code from the bus 417 into an inversion frequency signal which is applied to a analog scrambler mixer 421 to invert the audio signal input from user in-speech port 409. The analog scrambler mixer 421 may be implemented by using a Standard Microsystems Corporation COM9046 commercially available analog scrambler or equivalent circuit. The frequency inverted audio signal is output from the analog scrambler mixer 421 to a mute/bypass switch 423 and through modem message injection switch 425, each of which is controlled by the microcomputer 406. The output from the switch 425 is applied to an amplifier 403 and output as a scrambled signal on network out-speech port 411.

Similarly, the network in speech rolling code is output on bus 427 to a clocked frequency generator 429 for conversion to the appropriate inversion frequency signal and for application to one port of the analog scrambler mixer 431. The scrambled frequency inverted network in-speech signal is applied to another port of the analog scrambler mixer 431 for reinversion in accordance with the network in-speech inversion frequency signal and output to a bypass switch 433 (which is also controlled by the microcomputer 406). The output from the mute/bypass switch 433 is amplified by amplifier 402 and output as a clear audio output signal to the user out-speech port 415.

In order that the microcomputer 406 be enabled to communicate with a companion microcomputer in the scrambler station at the distant end, an originate/answer modem 407 accepts data from the microcomputer 406 for transmission to the distant end companion scrambler microcomputer and accepts data from the far end companion microcomputer for presentation to the microcomputer 406. In one implementation of the preferred embodiment, modem 407 is a 300 baud modem such as a National Semiconductor 74HC943 or equivalent.

Figure 5:
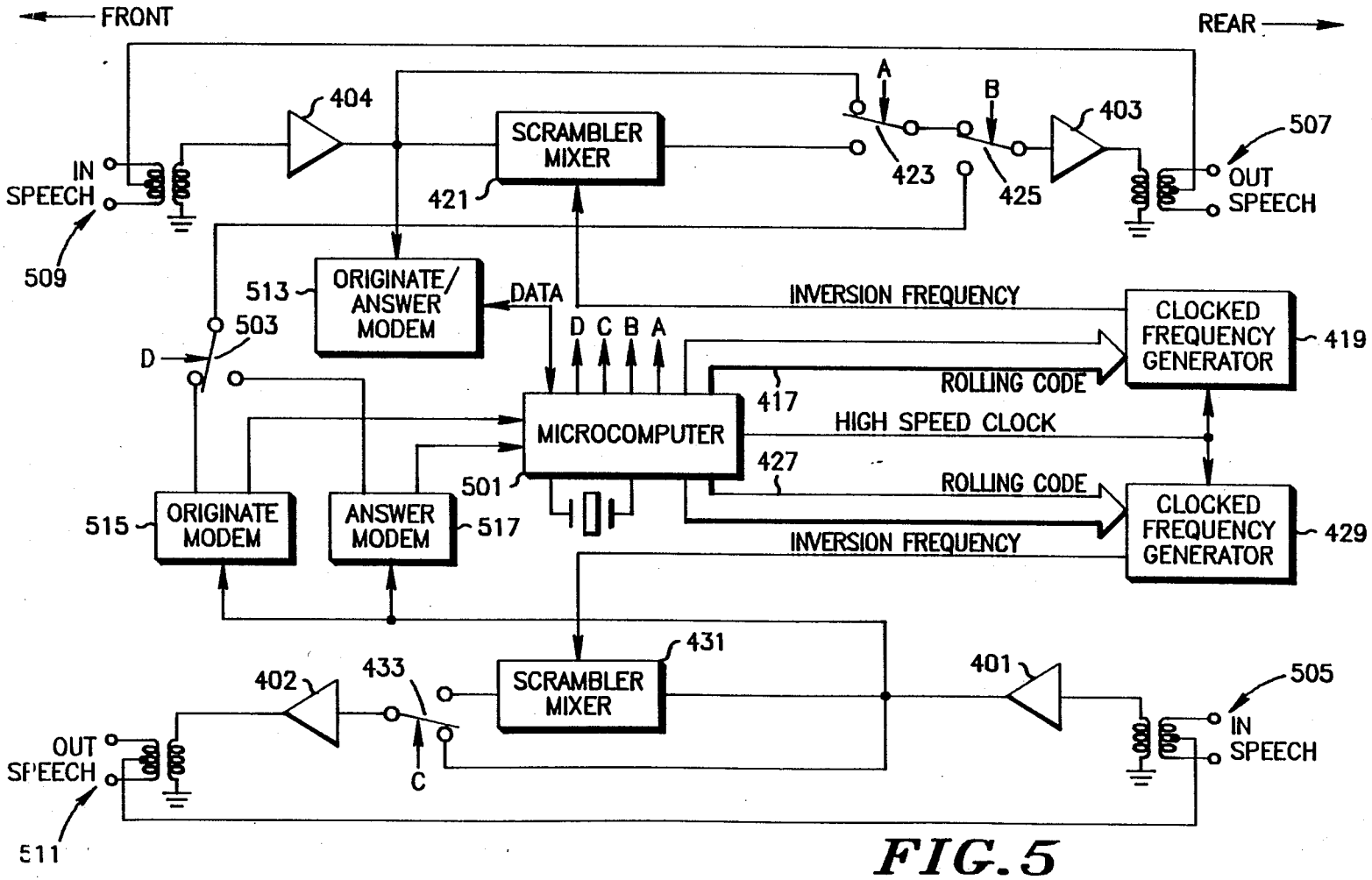
FIG. 5 is a block diagram of a directional tandem scrambler capable of operating in accordance with the present invention.
Figure 7:
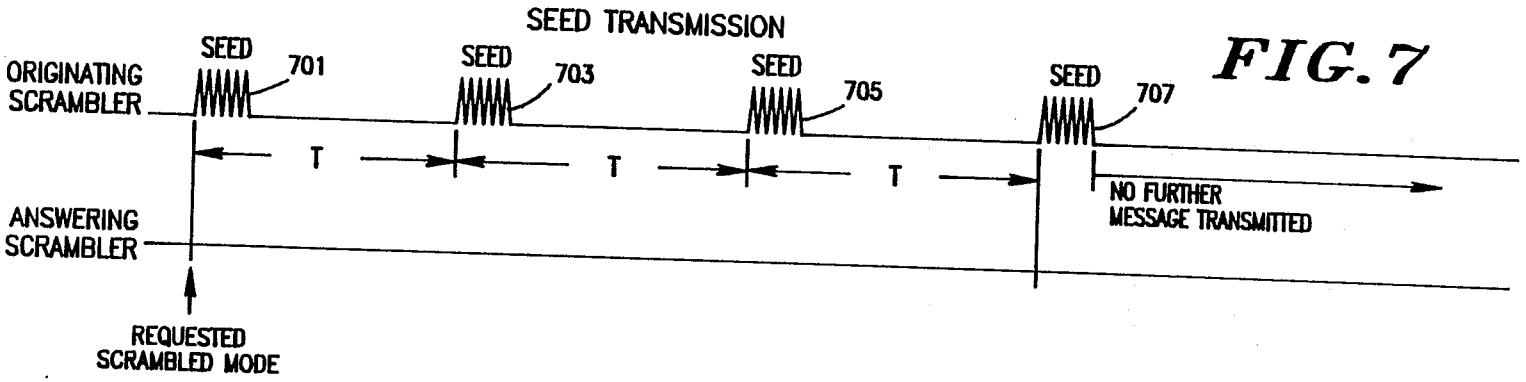
FIG. 7 is a timing diagram of an attempted initiation of scrambling employed by the present invention, to which there is no response.

A DM-Scrambler which may be used in the present invention is depicted in FIG. 5. In the preferred embodiment it is a four-wire tandem device with adequate gain and padding provided by amplifiers 401, 402, 403, and 404 to provide proper internal audio power levels and zero insertion loss in both directions. It is similar to the X-Scrambler of FIG. 4, with the following differences: A DM-Scrambler operates without any external control signals other than the messages received by its various modems. Thus, microcomputer 501 (which may be an 8-bit microprocessor such as a Motorola type MC6805 or equivalent with associated peripherals) performs the following activities. In the passive state, using controls A, C and B, it manipulates mute/bypass switches 423 and 433, and modem injection switch 425, respectively, to provide continuity in both directions. Originate modem 515 and answer moden 517 replace the originate/answer modem 407 of the X-Scrambler, permitting the microcomputer 501 to listen simultaneously for messages in both answer and originate bands, respectively, arriving on front in-speech port 509 (the direction it "faces"), and originate/answer modem 513, connected to listen to the rear, is added. When microcomputer 501 hears (from the front) any attempt to establish a C-path, it uses control D to set switch 503 to select the respective modem for sending (toward the front); it also commands originate/answer modem 513 to listen on the alternate band so as to read companion messages that might (or might not) arrive via rear in-speech port 505. When microcomputer 501 hears an X-Scrambler attempting to establish a C-Path from the front in the absence of corresponding activity from the rear, and after a suitable delay, it establishes a C-path with that X-Scrambler, setting switch 425, via control B, to select the modem audio from switch 503 only long enough to send each message. With the C-path established, microcomputer 501 uses scrambler mixer 431 to descramble the scrambled speech being received from rear in-speech port 505 and scrambler mixer 421 to scramble the clear speech being received from front in-speech port 509. It sets mute/bypass switches 423 and 433, via controls A and C respectively, to route the outputs of the scrambler mixers to out-speech ports 507 and 511 respectively. Throughout its handshake, and even while scrambling, microcomputer 501 uses originate/answer modem 513 to continually listen to the rear for messages that would indicate the potential for end-to-end scrambling, in which case it will revert to the passive state in a way that stimulates an end-to-end C-path to be established.

FIG. 6 illustrates a typical message format which may be used in the present invention. Following a message synchronization pattern 601, a series of opcode bits 603 are employed to define a particular message type being transmitted. Among these message types are the SEED message, the seed CONFIRMation message, the SYNChronization signal, the SYNCronization REQuest message, the SYNChronization LOST message, the CLEAR message. The optional data field 605 is used only with those messages requiring additional data for example the seed number in the SEED and CONFIRM messages. One bit 607 is used to distinguish whether a user scrambler or a tandem scrambler originated the message, so as to allow an interworking terminal scrambler to determine and indicate whether the entire circuit is scrambled, or just part of it.

Figure 11:
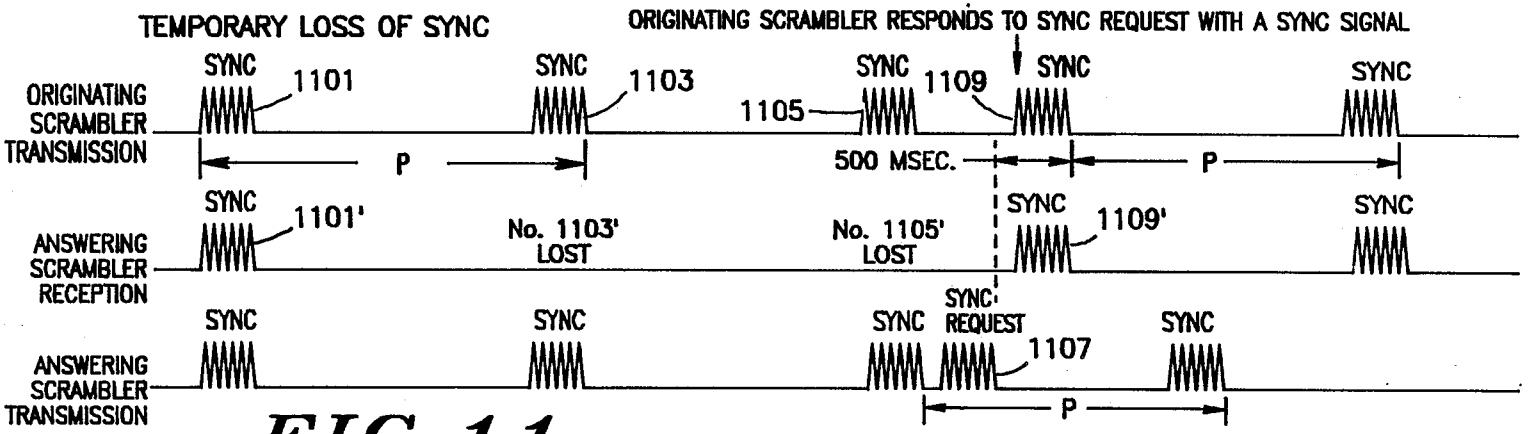
FIG. 11 is a timing diagram of scrambler signaling and operation during a temporary loss of synchronizing signals in accordance with the signaling used in the present invention.
Figure 12:
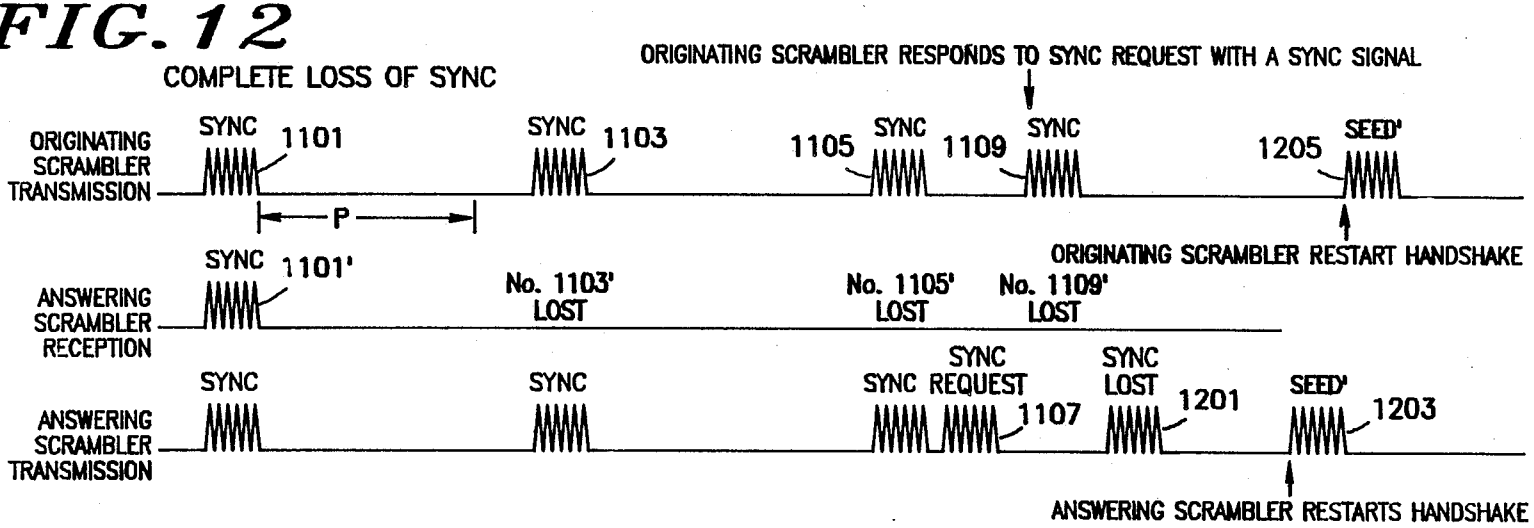
FIG. 12 is a timing diagram of scrambler message signaling and operation after a complete loss of synchronization in accordance with the signaling used in the present invention.
Figure 13:
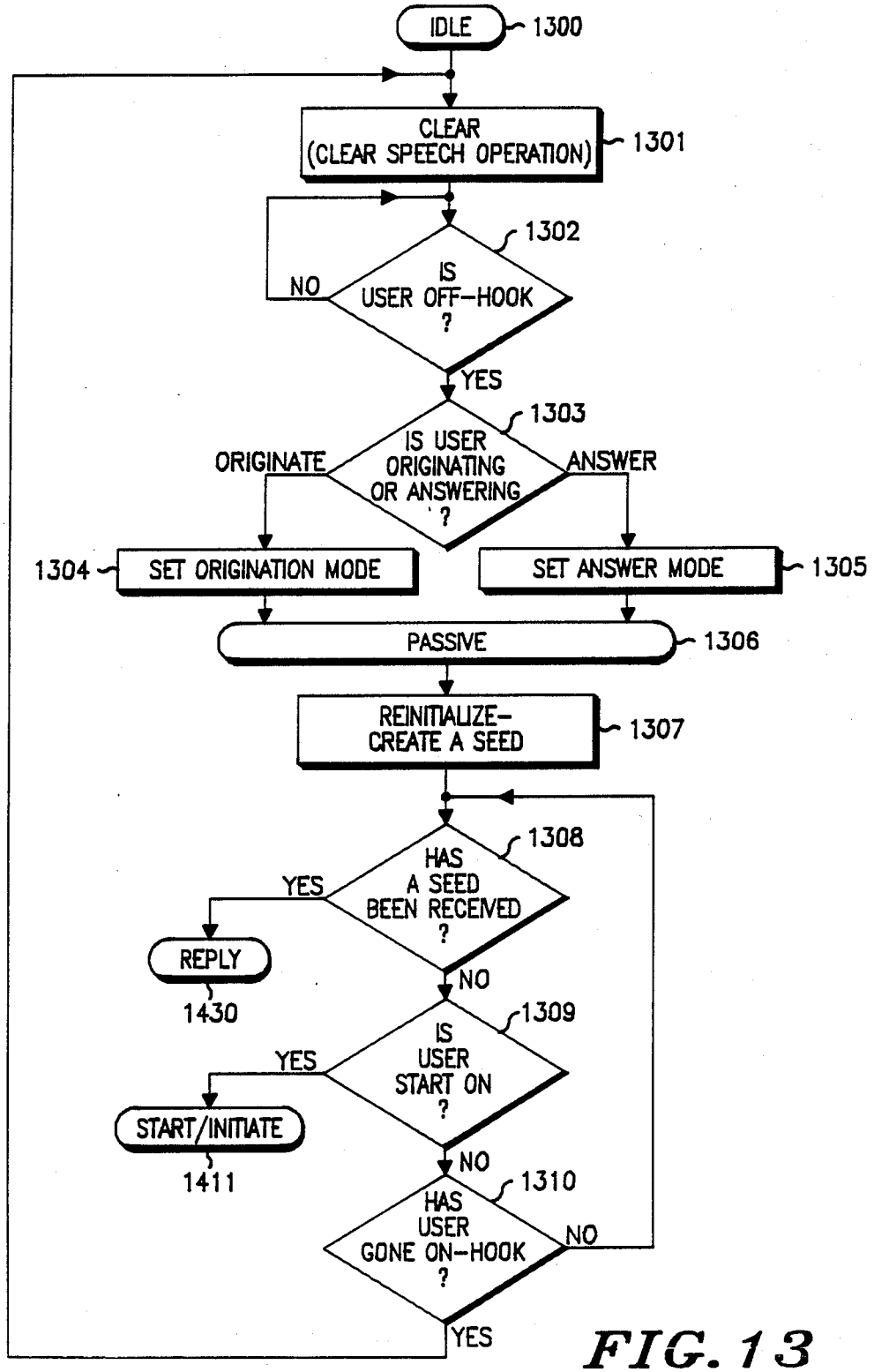

FIGS. 7 through 12 describe, by way of timing diagrams, the message exchanges used in the present invention to establish a C-path. The exchange of seeds and synchronization for establishing and clearing of Scrambled Mode is shown in FIGS. 7, 8, 9, and 10. Operation during loss of synchronization either by circuit fading or by handoff is shown in FIGS. 11 and 12.

When a user of a scrambler requests a scrambled mode of operation, the modem in his X-Scrambler (or RX-Scrambler) is set to the proper mode, depending on the user's position in the call (originate or answer). One or the other scrambler will start first, as in FIG. 7, sending a randomly generated number 701 (a "SEED") at 300 baud in one implementation of the preferred embodiment. After a predetermined time, T, and in the absence of a reply, the originating scrambler sends a second SEED 703. Additional attempts at conveying the seed may be made at intervals (705, 707) and, if no response is received from the other station, no further seed transmissions are made and the attempt at establishing a C-path fails.

Figure 8:
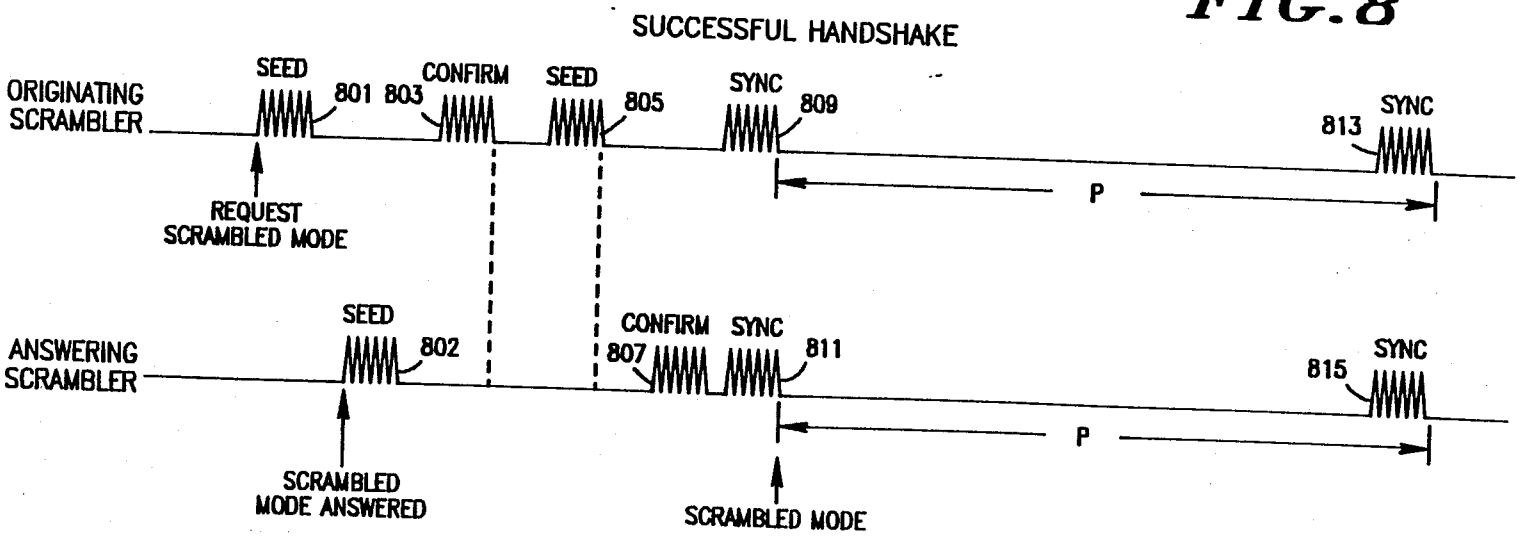
FIG. 8 is a timing diagram of a successful handshake seed messages by an originating and an answering scrambler station employed in the present invention.

If, however, a SEED 801 of FIG. 8 is heard by an answering scrambler, the answering scrambler responds with its own unique SEED 802. The originating scrambler acknowledges the transmission of the answering scrambler with a confirmation message 803 containing a repetition of SEED 802. Following the originating scrambler transmission of the confirmation message 803, a second transmission of the originating scrambler SEED occurs at 805 on half of the duplex channel followed by a confirmation message 807 by the answering scrambler on the other half of the duplex channel. The answering scrambler having sent a SEED and a CONFIRM and having heard a valid CONFIRM, sends SYNC 811. The originating scrambler, upon validly hearing CONFIRM 807 proceeds by sending SYNC 809. The SYNC messages 809 and 811 are sent at approximately the same time. Coincidence is not a necessity, since the absolute starting each scrambler's scrambling is synchronized to its own transmitted SYNC messages, and each scrambler's descrambling is synchronized to the received SYNC messages. However, during scramble mode, the SYNC messages are repeated at regular intervals, P. Since the descramblers will mute their outputs during the anticipated SYNC message arrival, a coincidence of muting will minimize echo aggravation if the circuit outside the C-path (at either or both ends) has a low echo return loss.

Figure 9:
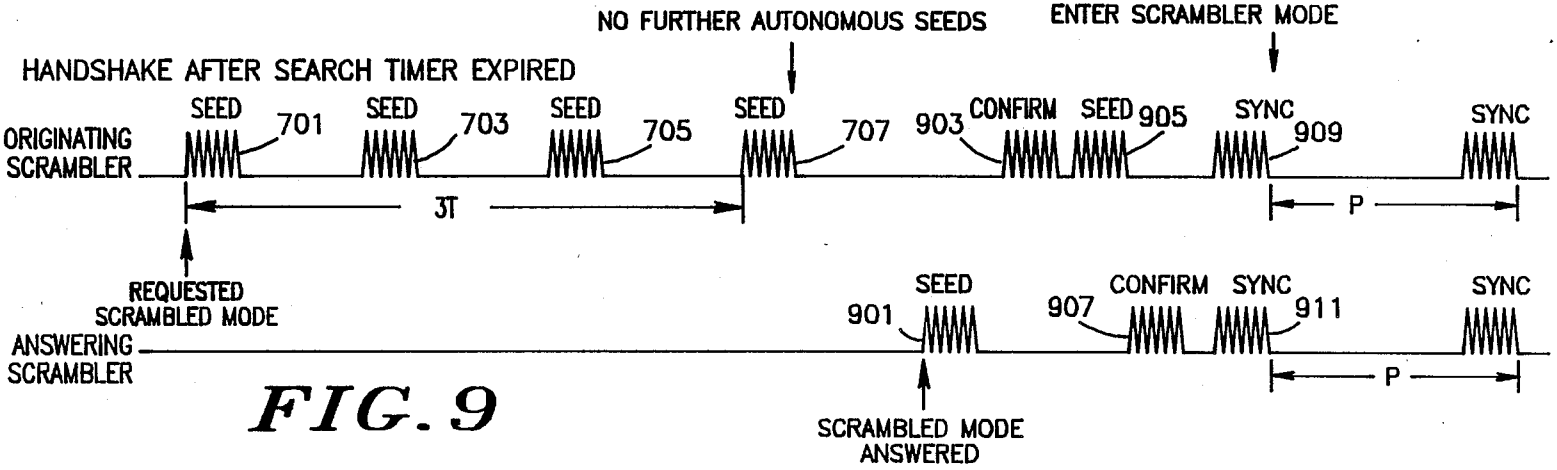
FIG. 9 is a timing diagram of a handshake after the search timer has expired in the orginating scrambler station employed in the present invention.
Figure 10:
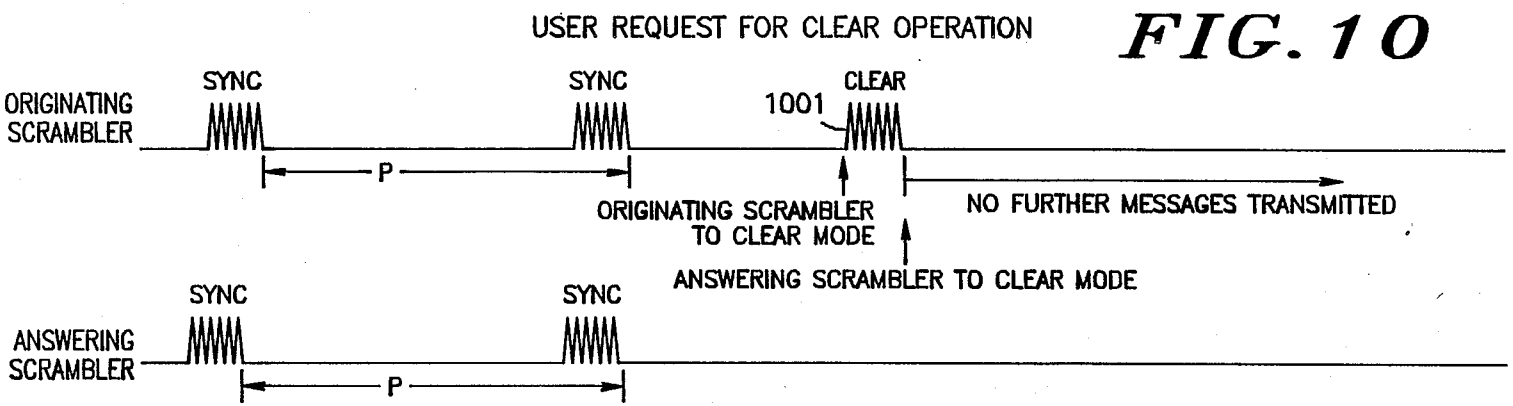
FIG. 10 is a timing diagram of a user request for clear speech operation from an originating scrambler station employed in the present invention.

A successful handshake can occur even if a scrambler has sent its fourth SEED message 707 without evoking a response as shown in FIG. 9. When the answering scrambler commences scrambled mode like an originating scrambler, it initiates the process of sending up to four SEED messages, the first of which 901, evokes a CONFIRM 903 and an originating scrambler 905 from the originating scrambler. This SEED 905 evokes a CONFIRM 907, followed by SYNC 911 from the answering scrambler. The answering scrambler is CONFIRM 907 evokes nearly simultaneous SYNC 909 from the originating scrambler. Each confirmation must be received by the sender of the seed which evoked it within a fixed period of time.

The originating user may wish to stop the scrambled operation, as directed by a Stop command to the microcomputer of the originating scrambler. This command evokes the transmission of a CLEAR message 1001 of FIG. 10, and returning to clear speech operation. At the reception of a CLEAR message, the answering scrambler returns to clear speech operation. A similar CLEAR message may be initiated by the answering scrambler to return the system to clear speech operation.

FIG. 11 depicts a temporary loss of synchronization by one of the scramblers. Either scrambler of the preferred embodiment may lose one-in-a-row SYNC message without taking any action. However, when two-in-a-row are missed, as the answering scrambler missed 1103 and 1105, it initiates a SYNC REQ message 1107 which evokes a new SYNC 1109 from its companion, which must be sent promptly but with due considerations to scrambler synchronizating limitations. FIG. 12 shows the action when the requested SYNC 1109 is not received; the requester sends a SYNC LOST 1201, goes to clear speech operation, and restarts the handshake with SEED 1203. A scrambler hearing a SYNC LOST 1201 message while in scrambled mode will return to clear speech operation and restart the handshake with a new SEED 1205.

In an X-Scrambler of the present invention, the method by which the microcomputer 406 performs the above protocol is described in FIGS. 13 and 14A through 14E. The process starts with on-hook Idle at 1300 of FIG. 13 and the process is initialized at 1301. When the user comes off-hook, detected at 1302, the Orig/Term user signal is sensed, at 1303, and the modem mode set correspondingly at 1304 or 1305, and the process enters the "Passive" state at 1306. The process then creates a seed at 1307 and waits for user action or a received SEED message in the loop at 1308, 1309 and 1310. A user OnHook at 1310 returns to Idle 1300; hearing a SEED at 1308 evokes a Reply 1430 described below; and user Start, at 1309 sends the process to Start-/Initiate 1411 of FIG. 14A.

Figure 14A:
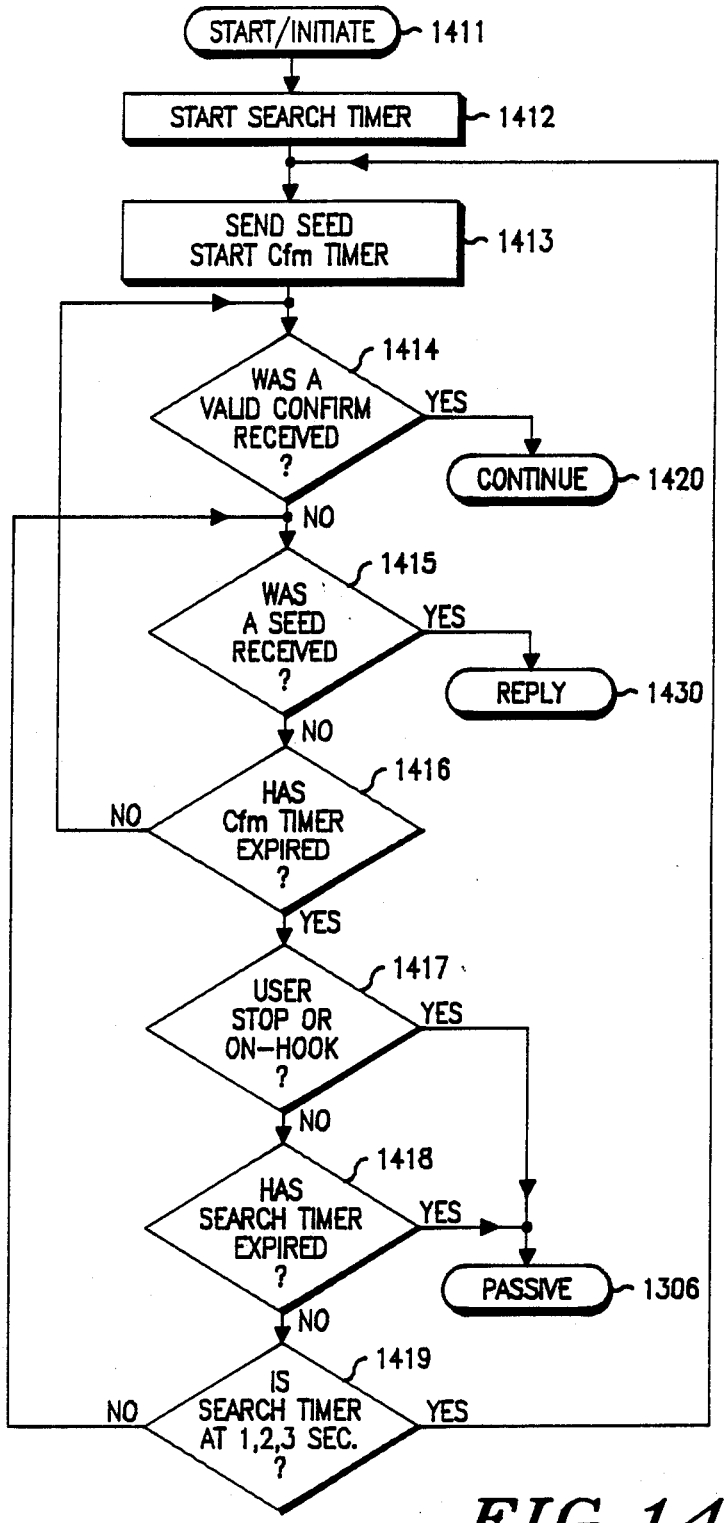

Referring now to FIG. 14A, the Search Timer is set at 1412, and the loop of 1413–1419 is entered, where it sends up to four SEED messages at 1413. After each, until the CONFIRM message timer "Cfm Timer" expires at 1416, the process checks for reception of valid CONFIRM at 1414 and a SEED at 1415. Receipt of a valid CONFIRM at 1414 sends the process to continue 1420 (FIG. 14B where it continues as initiator) described below. After Cfm Timer expires, and until the Search Timer reaches a 1-second (T) increment at 1419, the process checks for user intervention at 1417 and for Search Timer expiration at 1418, both of which sends it to "Passive" 1306.

Figure 14B:
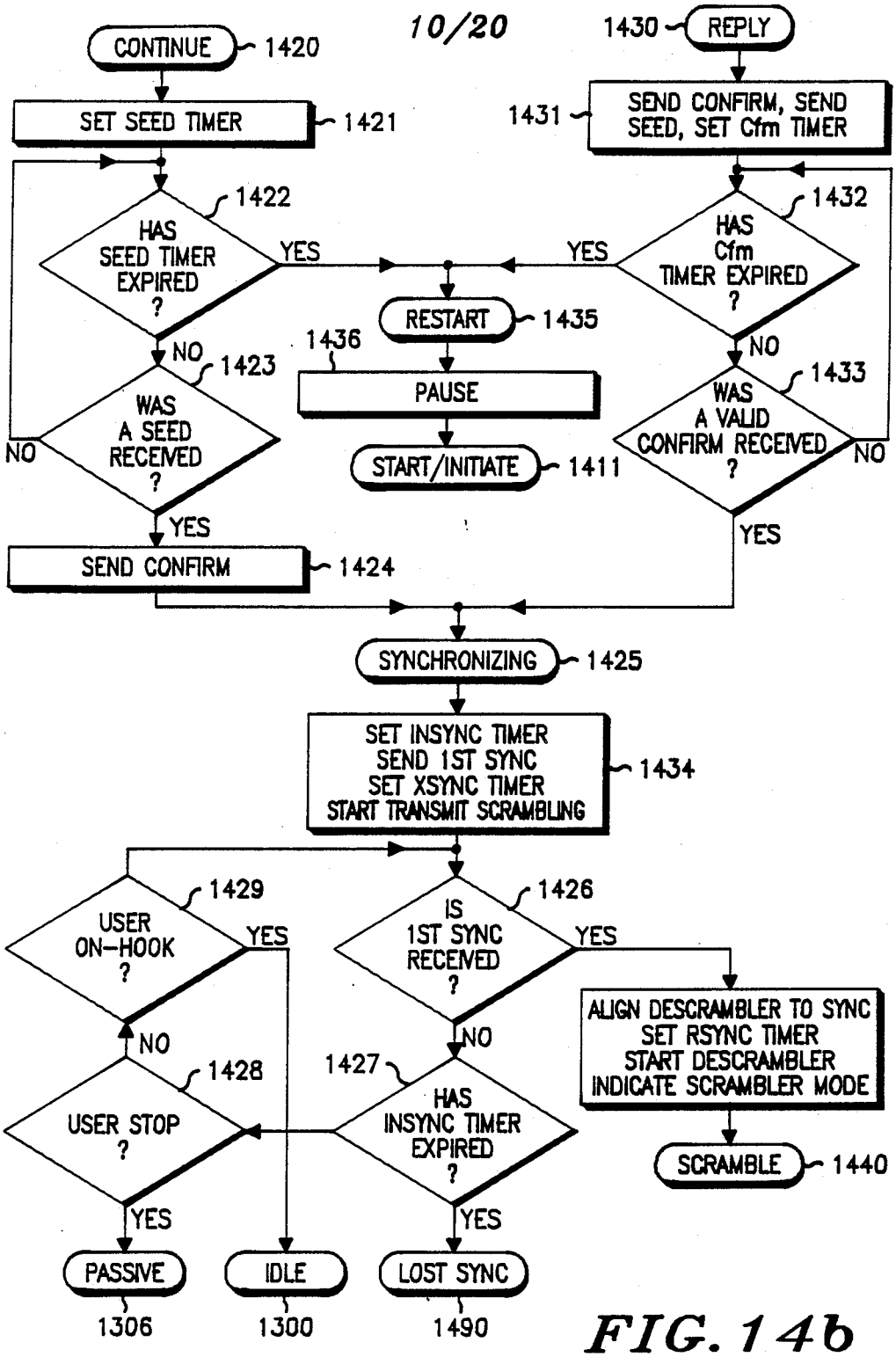

On FIG. 14B, both Continue 1420 and Reply 1430 attempt to complete an exchange of SEED and CONFIRM messages, defaulting to Restart 1435. Continue sets a Seed Timer at 1421 and expects to hear a SEED at 1423 following the previously received CONFIRM before the Seed Timer expires at 1422 to Restart. Receipt of a SEED evokes sending of a CONFIRM at 1424, and entering Synchronizing at 1425.

Reply at 1430 requires at 1431 setting a Cfm Timer, sending a CONFIRM acknowledging the previously receive SEED followed by sending a SEED and then waiting until receipt of a valid CONFIRM at 1433, which will initiate Synchronizing 1425, else Cfm Timer expires at 1432 to Restart.

Restart 1435 effects a pause at 1436 before entering Start/Initiate. Synchronizing is to effect an exchange of the first SYNC messges, and is started at 1434 by sending a SYNC and starting the scrambler and its Xsync and Insync Timers, then waiting for a SYNC reception until either Insync Timer expires at 1427 to Lost Sync 1490, described below, or the user intervenes at 1428 or 1429.

Figure 14D:
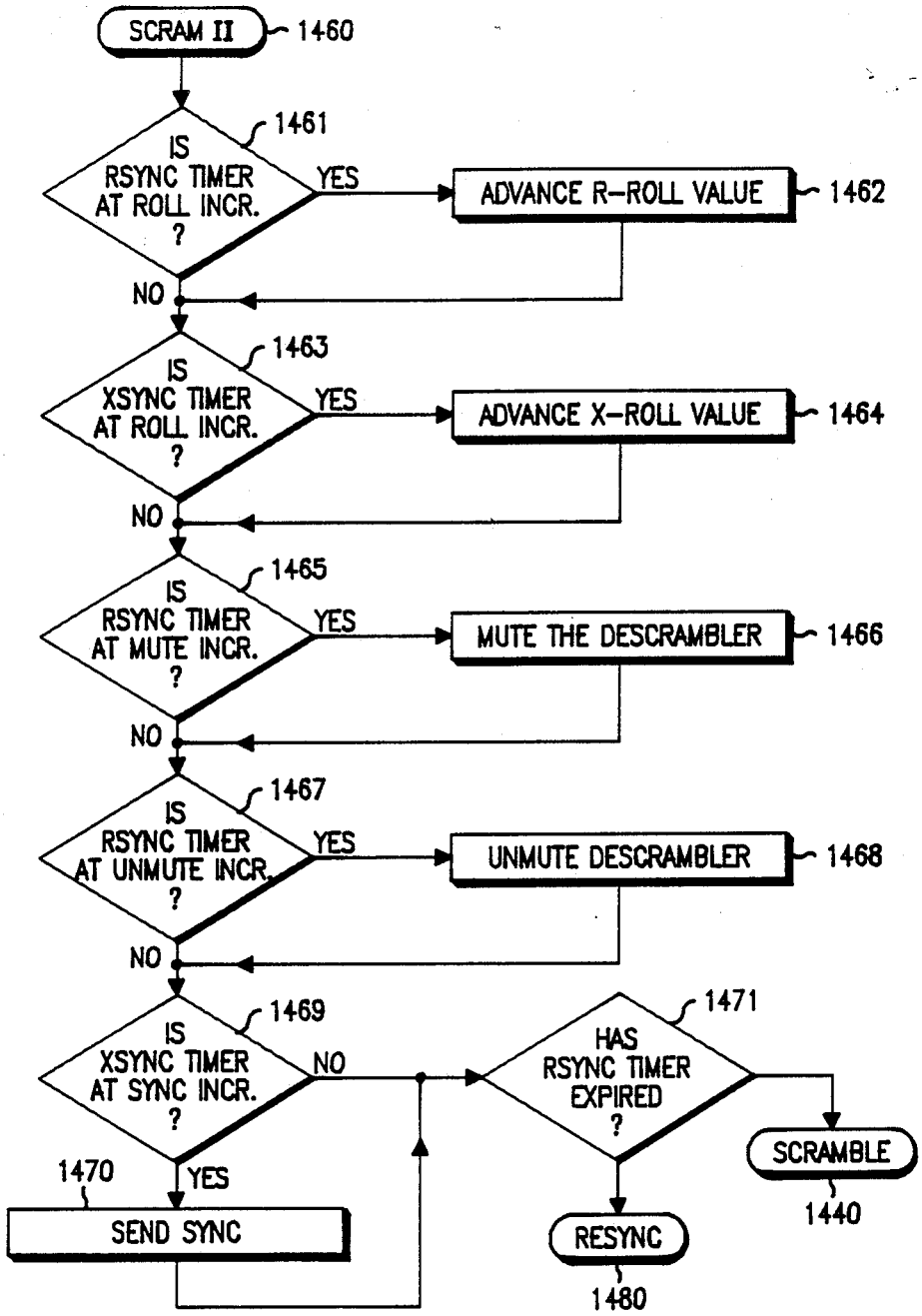

Successful SYNC reception at 1426 leads to starting the descrambler at 1439 and Scrambled Mode Loop which starts at 1440 of FIG. 14C and continues through 1471 of FIG. 14D before looping back. Within the Scrambled Mode loop of FIGS. 14C and 14D, SYNC messages are sent at 1470 when Xsync Timer reaches a Sync Increment at 1469, usually every 6.0 seconds (P) unless a SYNC REQ message was received at 1444 causing at 1445 an adjustment which will shorten up the increment to the next nearest 0.1-second. The rolling and muting functions of 1461, 1462, 1463, 1464, 1465, 1466, 1467 and 1468 are scrambler/descrambler control operations. Each received SYNC at 1446 realigns the descrambler timing and resets the Rsync Timer at 1447.

There are branching points out of the loop of FIGS. 14C and 14D for receipt of a CLEAR or SYNC LOST message, User Stop or On-Hook, and expiration of Rsync Timer. Receiving a CLEAR at 1441 evokes "Passive" (1306 of FIG. 13), receiving a SYNC LOST at 1442 evokes Retry 1495, described below, and user intervention at 1448 evokes sending a CLEAR message at 1443 and then "Passive" 1306. Rsync Timer will expire in the absence of a two-in-a-row received SYNC messages, evoking, at 1471, a Resync 1480, described below.

Figure 14E:
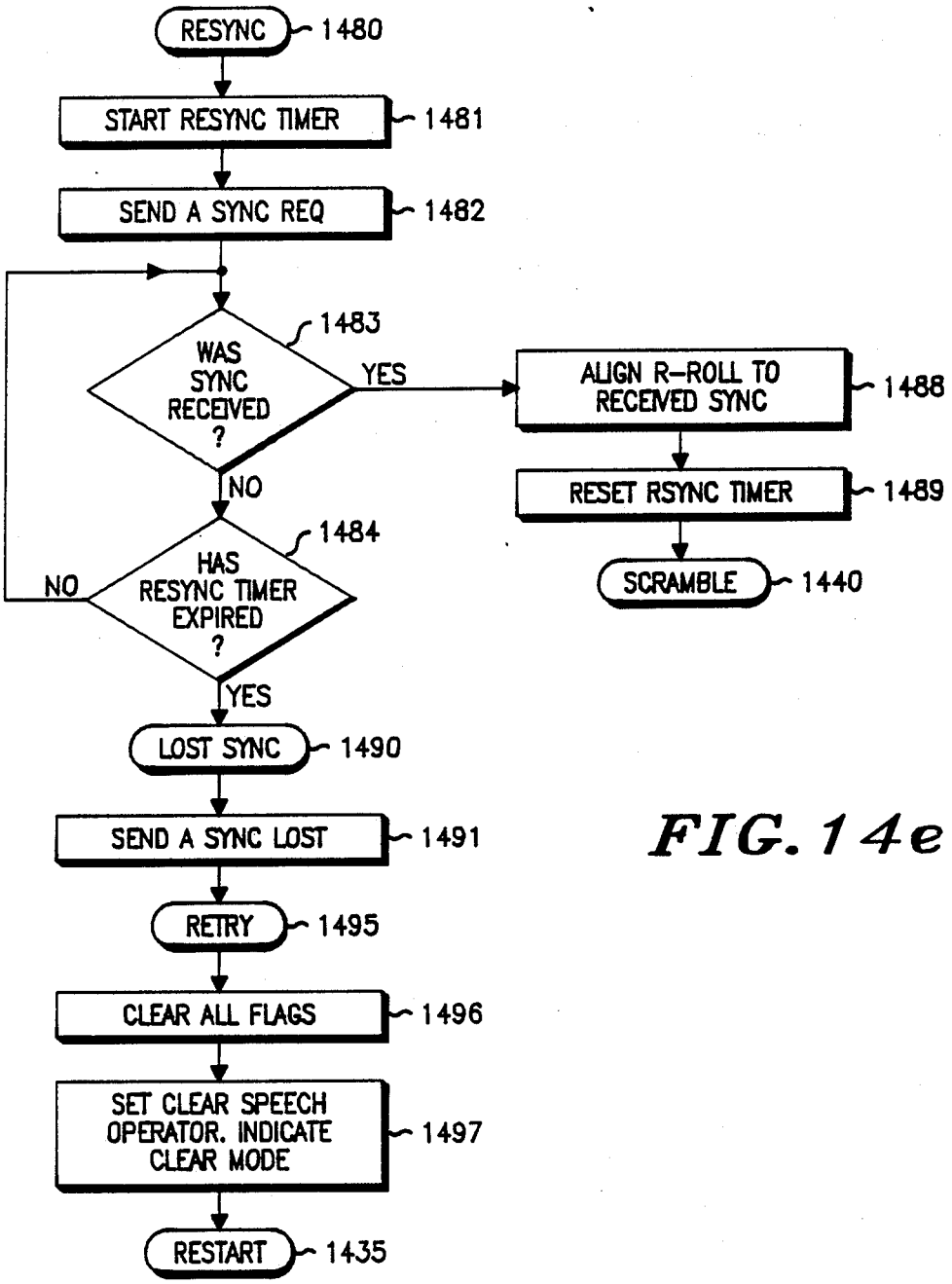

FIG. 14E illustrates Resync, Lost Sync and Retry. At Resync 1480, after starting Resync Timer at 1481 A SYNC REQ message is sent at 1482; a timely reply SYNC message at 1483 resynchronizes the descrambler at 1488 and resets Rsync Timer at 1489, and returns to Scramble 1440. If Resync Timer expires at 1484, Lost Sync 1490 is entered. When Lost Sync occurs, a SYNC LOST message is sent at 1491 and Retry 1495 is entered. In Retry 1495, flags are cleared at 1496, clear speech operation is started at 1497 and Restart 1435 of FIG. 14B is entered. The X-Scrambler is thus able to operate in accordance with the timing diagrams of FIGS. 7 through 12.

Figure 15A:
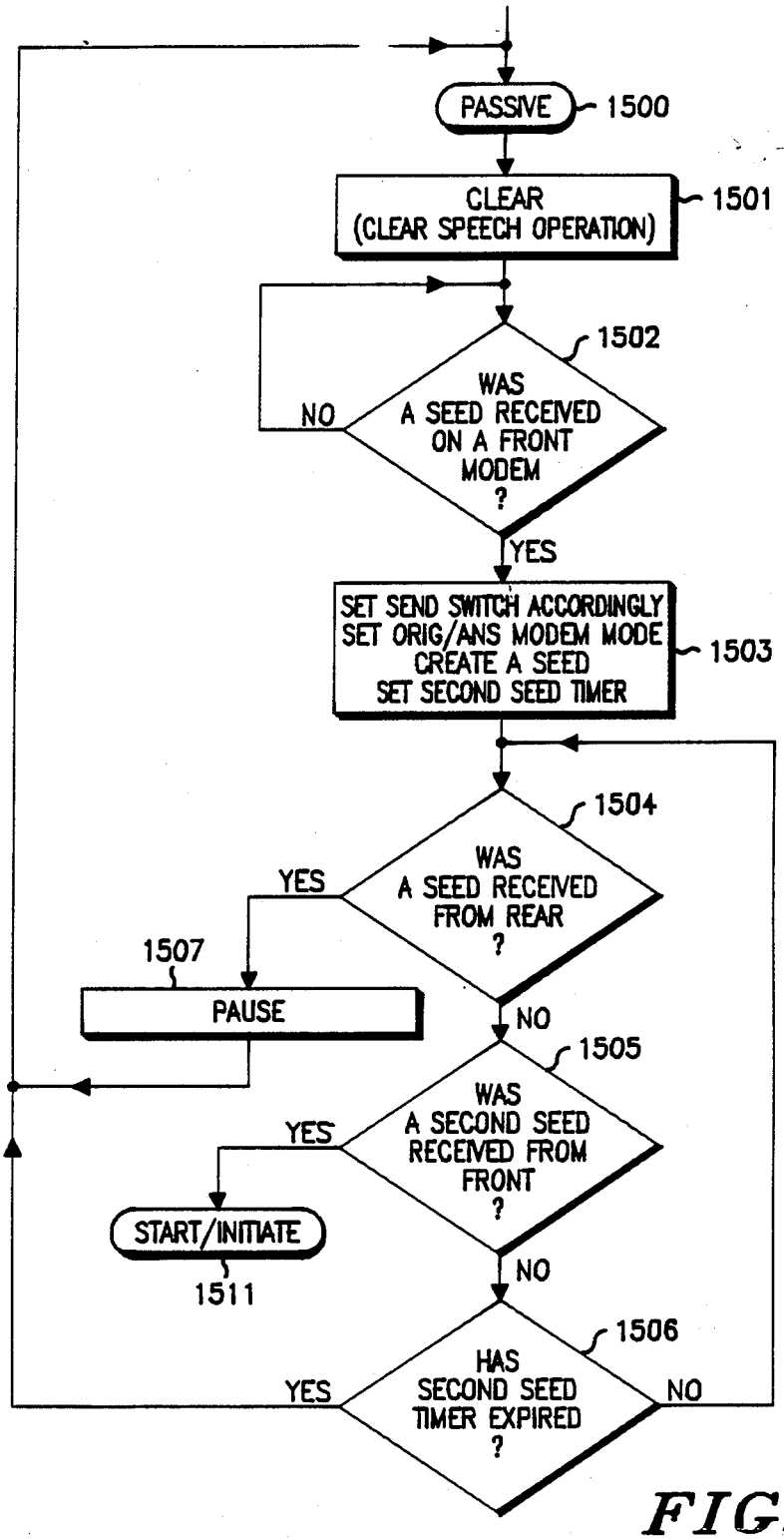
FIGS. 15A through 15F are a flowchart of the message handling processes of a directional tandem scrambler that employs an embodiment of the present invention.

In a DM-Scrambler, the process by which the microcomputer achieves its system operation is shown in the flowcharts of FIG. 15A through FIG. 15F. Passive 1500 on FIG. 15A is the starting point. When idle (Passive), a DM-Scrambler provides circuit continuity at 1501 and awaits the receipt of a SEED message via either of the front facing modems (originate modem 515 or answer modem 517 of FIG. 5) at 1502. Receipt of a SEED by either modem breaks out of the loop at 1503, selecting that receiving modem for sending, putting the rear facing Orig/Ans modem in complementary mode so that it can hear replies from more distant scramblers, and setting a Second Seed Timer. The selected modem now listens for SEED messages from the rear at 1504 as well as for a second SEED from the Front at 1505. If the Second Seed Timer expires at 1506 with no further seeds, it returns to Passive at 1500. A SEED from the Rear leads to a Pause at 1507 so as not to interfere with a handshake attempt by a more distant scrambler, and then returns to Passive at 1500. At 1505, a second SEED (in a row) from the front, on the same band as the first, and with none being received from the rear evokes at Start/Initiate at 1511 in FIG. 15B.

Figure 15B:
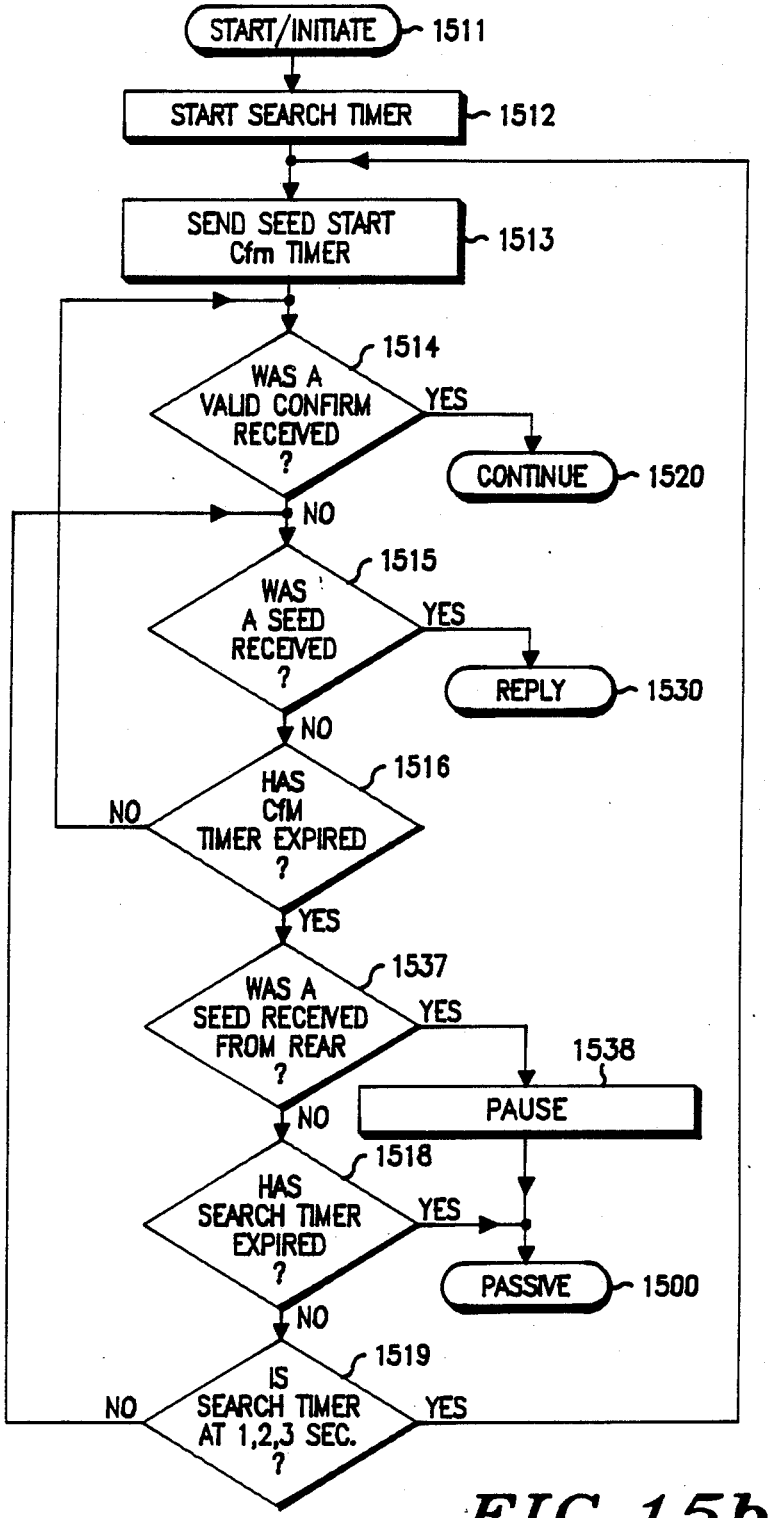
Figure 15C:
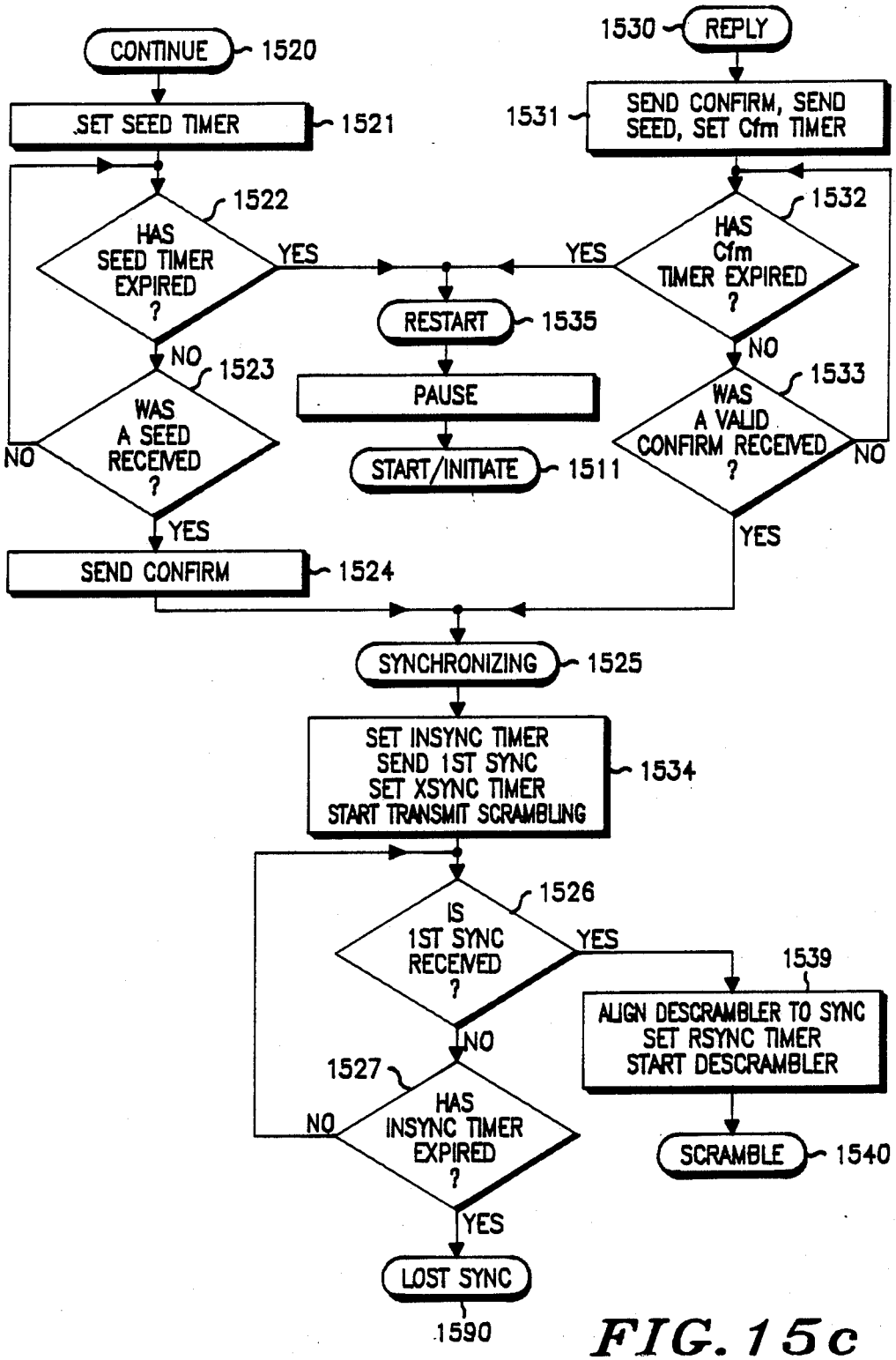
Figure 15D:
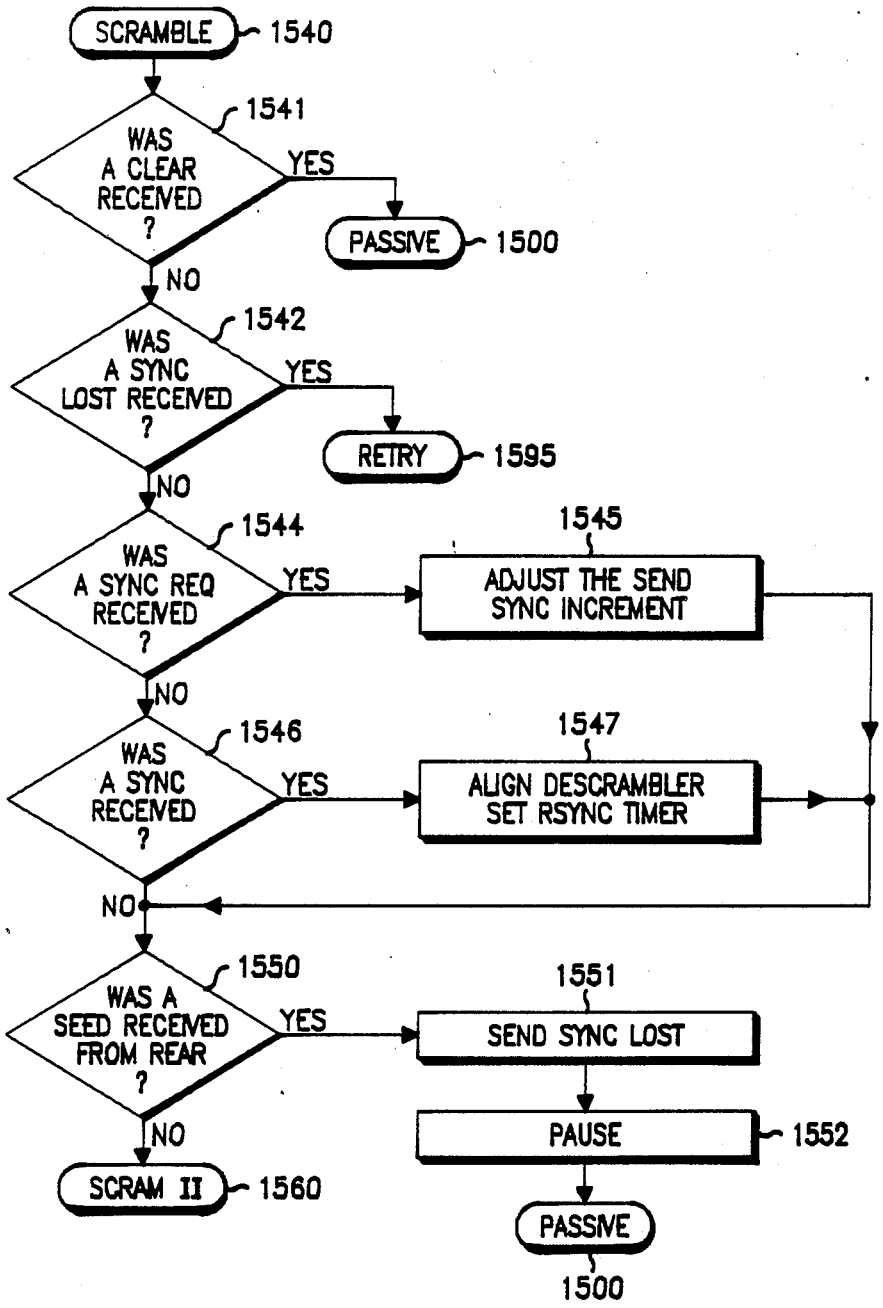
Figure 15E:
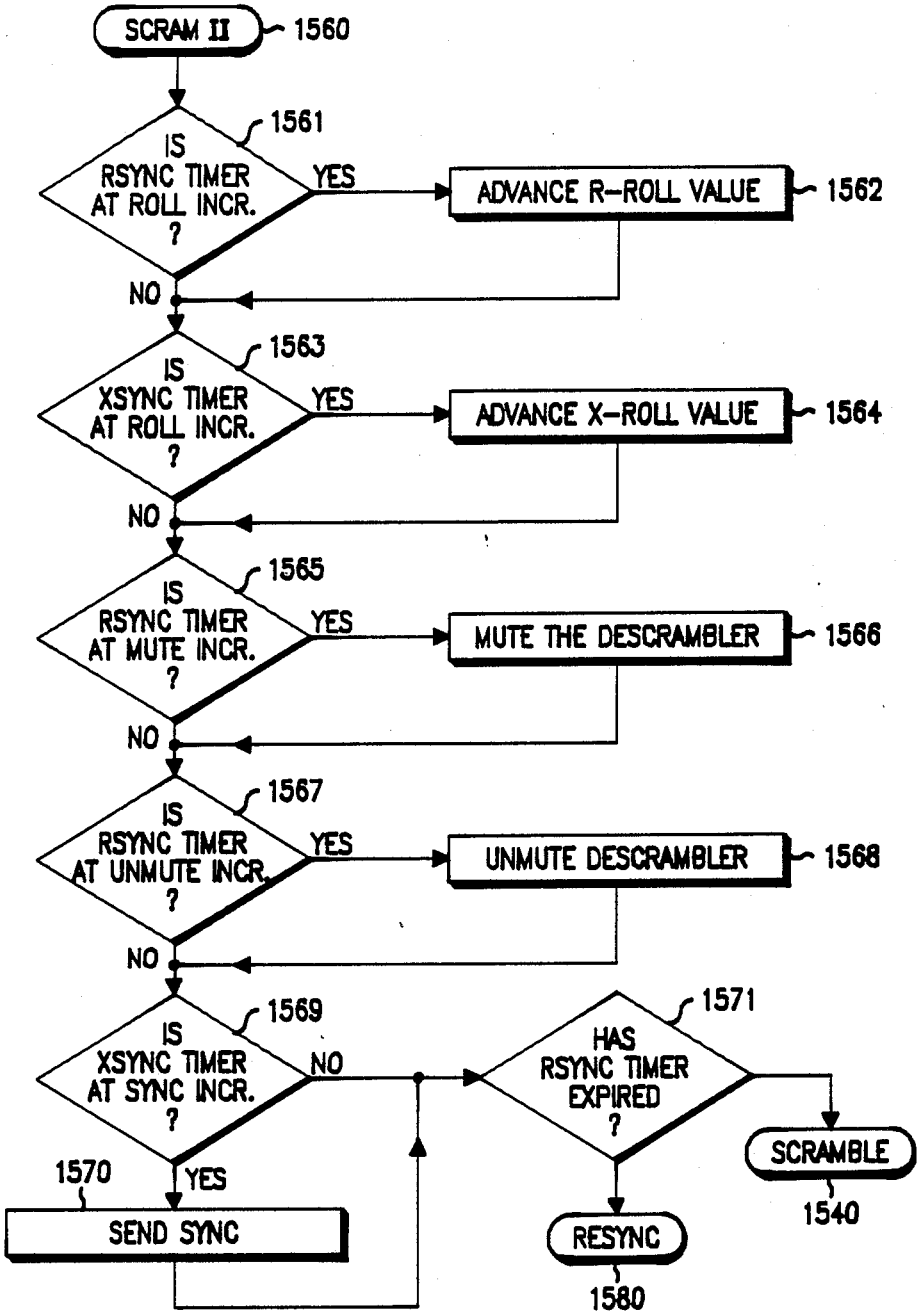
Figure 15F:
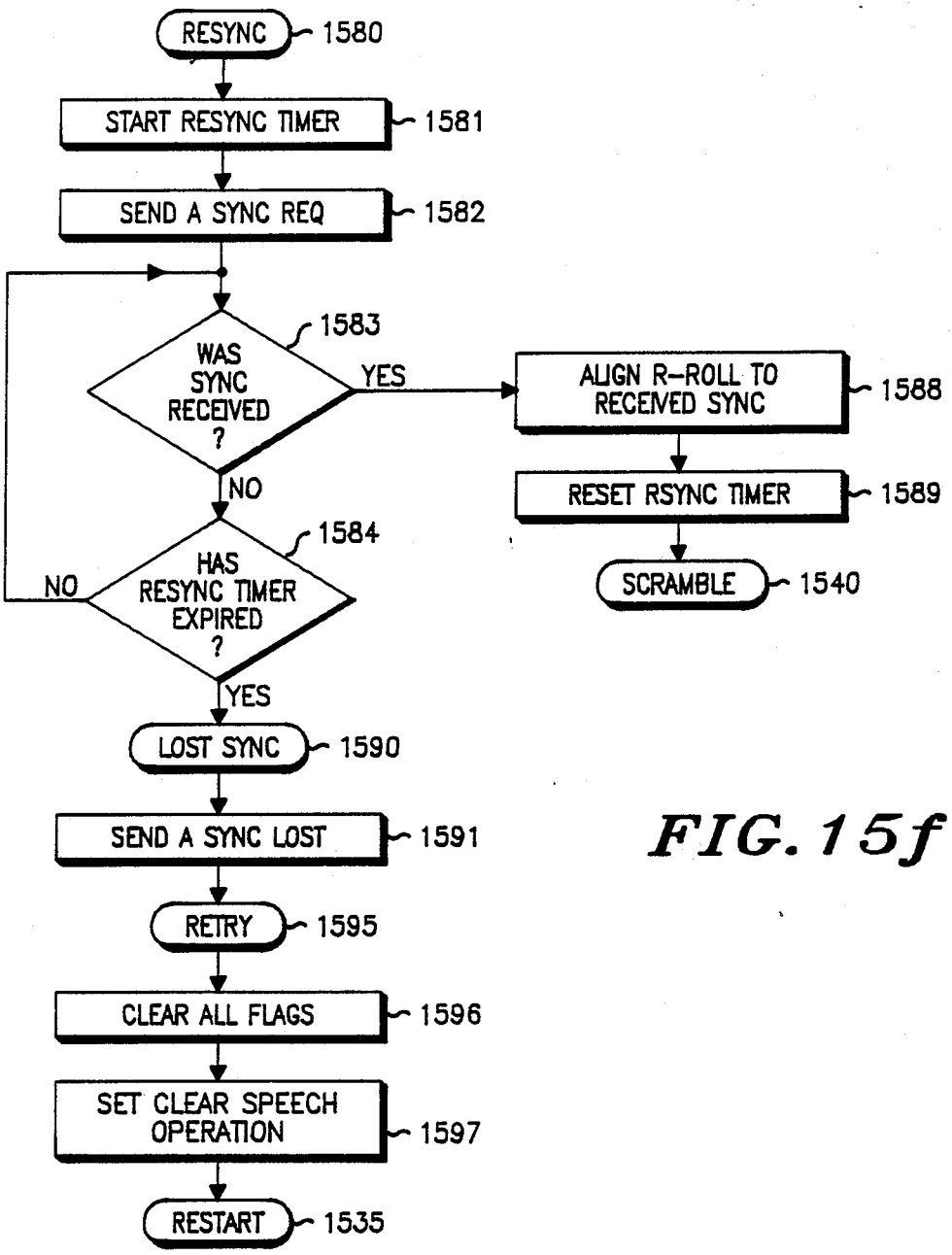

Continuing in FIG. 15B, the Start/Initiate process which starts at 1511 sends up to 4 SEED messages, in the same manner as the X-Scrambler on FIG. 14A, except that if while doing so a SEED message received from the rear at 1537 will cause it to Pause 1538 and return Passive. Also, sampling of the user controls is absent, since there are none. The handshake of FIG. 15C is like that of the X-Scrambler of FIG. 14B, described above. The scrambled mode of FIGS. 15D and 15E is also very similar to FIGS. 14C and 14D, respectively, except that, in FIG. 15D, the user controls are absent, and a SEED received from the rear at 1550 evokes sending of a SYNC LOST message at 1551 and a Pause at 1552 before returning to Passive at 1500. This permits the X-Scrambler it is facing to establish a C-path with a late arriving X-Scrambler at its rear. Resync, Lost Sync and Retry on FIG. 15F work like those of the X-Scrambler shown on FIG. 14E and described above.

By the above action, all cascaded DM-Scramblers employing the present invention will hear SEED message sent from the front, adapt their Orig/Ans mode correspondingly, and maintain circuit continuity in the presence of an X-Scrambler at the rear. Operationally, it is important to note that with no X-Scrambler at the rear, all will send a SEED in reply to the second. All but the most distant will hear a SEED from the rear, pause, and enter the Passive state, permitting only the most distant scrambler's follow-on SEED and CONFIRM messages to reach the X-Scrambler. In most situations X-Scrambler hears the SEED from the nearest DM-Scrambler, this one in general having a different seed code than the more distant. The X-Scrambler responds with an CONFIRM that the most distant will regard as invalid so that the most distant DM-Scrambler enters Restart while X-Scrambler sends SYNC, and receiving no reply, also enters Restart. Now, all but the most distant DM-Scrambler have paused and sent no response to the first SEED heard. This inaction permits the most distant DM-Scrambler to handshake with the originating X-Scrambler. Furthermore, if a DM-Scrambler starts to establish, or has established, scrambled mode with an X-Scrambler it faces, within a second of the time an X-Scrambler at its rear attempts to establish a C-path, the DM-Scrambler will have restored circuit continuity and stimulated the X-Scrambler it faces to establish a new C-path with the X-Scrambler at its rear.

Figure 16:
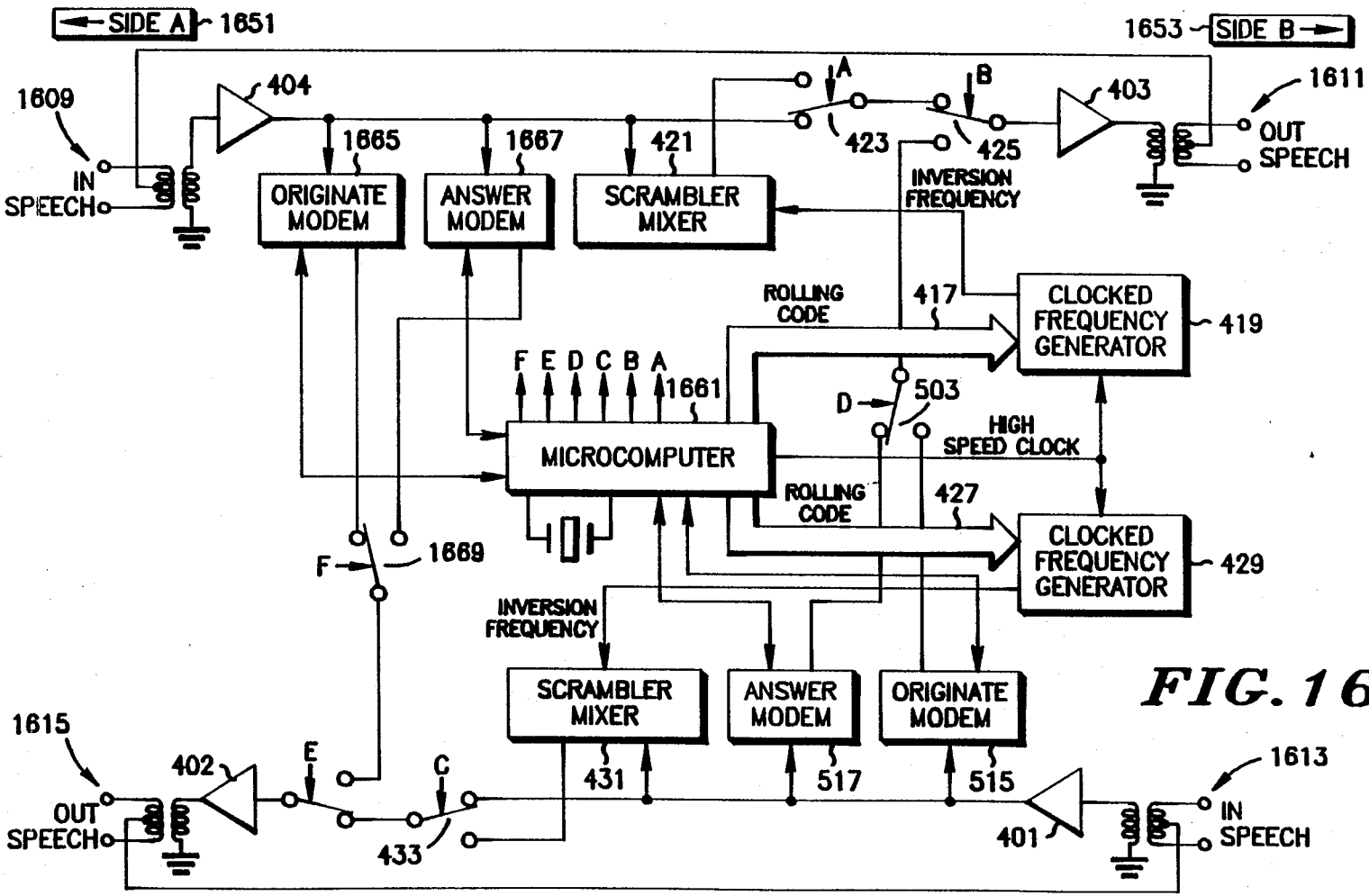
FIG. 16 is a block diagram of a tandem scrambler of the present invention that can establish and maintain scrambling with a scrambling terminal at either end of a circuit.

An alternative embodiment of the DM-Scrambler (called herein M-Scrambler) will establish a Cpath (and two way scrambling) in either direction as shown in FIG. 16. It has no front and rear, but only Side A (1651) and Side B (1653). Its modem arrangement is fully symmetrical, permitting it to receive both originate and answer messages and to send messages in both directions. Each of the Scrambler/mixers 421 and 431 can either scramble or descramble, as directed by microcomputer 1661. In the Passive state, the M-Scrambler's microcomputer 1661 waits for a SEED from any of the four modems 515, 517, 1665 and 1667 making a tentative choice as to which direction it will face and which Scrambler/mixer will scramble and which will descramble, should a second SEED force it active before a SEED from the other direction sends it to Pause and Passive. Other than this, its flow chart is the same as the DM-Scrambler.

In summary, a method and apparatus have been shown and described by which it is possible to establish and maintain two-way data communications between a terminal and the most distant companion equipment on the circuit, tandem or terminal, in the presence of other intervening tandem companion equipment. The immediate application is pertinent to the control of analog voice band scramblers, but it is equally applicable to data encryption. While the preferred embodiment uses full duplex 300 baud modems over an normal voice-bandwidth circuit, many other data transmission techniques would suffice.

Therefore, while a particular embodiment of the invention has been shown and described, it is to be understood that the invention is not to be taken as limited to the specific embodiment herein and that changes and modifications may be made without departing from the true spirit of the invention. It is therefore contemplated to cover the present invention, and any and all such changes and modifications, by the appended claims.

We claim:

1. A method of establishing scrambled communications on a communications circuit which utilizes at least two communications links and has an originating scrambling terminal, an answering scrambling terminal, and at least one intermediate scrambler, comprising the steps of:

detecting, at the intermediate scrambler and the answering scrambling terminal, a first data message sent from the originating scrambling terminal;

determining, at the intermediate scrambler, if the answering scrambling terminal has sent a second data message in response to said first data message; and placing the intermediate scrambler in a transparent non-scrambling mode if the answering scrambling terminal has sent said second data message.

2. A method in accordance with the method of claim 1 further comprising the step of measuring a predetermined period of time following said detection of said first data message at the intermediate scrambler.

3. A method in accordance with the method of claim 2 further comprising the step of placing the intermediate scrambler in a scrambling mode if a third data message sent from the originating scrambling terminal is detected and the answering scrambling terminal has not sent said second data message within said measured predetermined time.

4. An intermediate scrambler for a communications circuit employing a seed message to establish scrambled communications and which has at least one terminal scrambler, the intermediate scrambler comprising:

means for detecting a first seed message sent from a first terminal scrambler;

means for determining if a second terminal scrambler has sent a second seed message in response to said first seed message; and means for placing the intermediate scrambler in a transparent non-scrambling mode if said second terminal scrambler has sent said second seed message.

5. An intermediate scrambler in accordance with claim 4 further comprising means for placing the intermediate scrambler in a scrambling mode if a third seed message sent from said first terminal scrambler is detected and said second seed message has not been sent.

6. An intermediate scrambler in accordance with claim 5 further comprising means for detecting said second seed message after the intermediate scrambler has been placed in said scrambling mode and for placing the intermediate scrambler in said transparent non-scrambling mode in response to said second seed message detection.

7. An intermediate scrambler in accordance with claim 5 wherein said means for placing further comprising means for generating a fourth seed message and sending said generated fourth seed message to said first terminal scrambler whereby a synchronizing and control data communications path between said first terminal scrambler and the intermediate scrambler is established.

8. An intermediate scrambler in accordance with claim 4 further comprising means for measuring a predetermined period of time following said detection of said first seed message.

9. A method of establishing scrambled communications on a communications circuit which utilizes a radiotelephone link and a landline telephone link and further has an originating scrambling terminal at one termination of the communications circuit, an answering scrambling terminal at the other termination of the communications circuit, and at least one intermediate scrambler at the interface of the radiotelephone link and the landline telephone link, comprising the steps of:

detecting, at the intermediate scrambler and the answering scrambling terminal, a first seed message sent from the originating scrambling terminal to establish scrambled communications;

measuring a predetermined period of time following said detection of said first seed message at the intermediate scrambler;

determining, at the intermediate scrambler, if the answering scrambling terminal has sent a second seed message in response to said first seed message within said measured predetermined time; and placing the intermediate scrambler in a transparent non-scrambling mode if the answering scrambling terminal has sent said second seed message within said measured predetermined time.

10. A method in accordance with the method of claim 9 further comprising the step of placing the intermediate scrambler in a scrambling mode if both a third seed message sent from the originating scrambling terminal is detected and the answering scrambling terminal has not sent said second seed message within said measured predetermine time.

11. An intermediate scrambler for a communications circuit which utilizes a radiotelephone link and a landline telephone link and further has at least one terminal scrambler at one termination of the communications circuit comprising:

means for detecting a first data message sent from a first terminal scrambler;

means for measuring a predetermined period of time following said detection of said first data message;

means for determining if a second terminal scrambler has sent a second data message in response to said first data message within said measured predetermined time; and means for placing the intermediate scrambler in a transparent non-scrambling mode if said second terminal scrambler has sent said second data message within said measured predetermined time.

12. An intermediate scrambler in accordance with claim 11 further comprising means for placing the intermediate scrambler in a scrambling mode if both a third data message sent from said first terminal scrambler is detected and said second terminal scrambler has not sent said second data message within said measured predetermined time.

13. An intermediate scrambler in accordance with claim 12 further comprising means for detecting said second data message after the intermediate scrambler has been placed in said scrambling mode and for placing the intermediate scrambler in said transparent non-scrambling mode in response to said second data message detection.

14. An intermediate scrambler in accordance with claim 12 wherein said means for placing further comprises means for generating a fourth data message and sending said generated fourth data message to said first terminal scrambler whereby a synthronizing and control data communications path between said first terminal scrambler and the intermediate scrambler is established.

15. A method of data transfer or exchange on all or part of a communications circuit which is composed of at least two communications links, a terminal data device, at least one intermediate data device at a junction between two links, and an answering data device, comprising the steps of:

detecting at an intermediate data device a first data exchange request message transmitted by the terminal data device;

detecting at said intermediate data device a second data exchange request message transmitted from an answering data device more distant on the communications circuit from said terminal data device than said intermediate data device;

placing said intermediate data device in a transparent mode if said second data exchange request message is detected, thereby permitting said more distant answering data device to directly exchange data with said terminal data device.

16. A method in accordance with the method of claim 15 further comprising the step of responding to said first data request message from said intermediate data device if said second data exchange request message is not detected.

17. A method in accordance with the method of claim 15 further comprising the step of presenting, in human perceptible form at said terminal data device, an indication of said second data exchange request.

* * * * *

UNITED STATES PATENT AND TRADEMARK OFFICE

CERTIFICATE OF CORRECTION

PATENT NO. : 4,914,696

DATED : Apr. 3, 1990

INVENTOR(S) : Cary M. Dudczak, Mark W. McGuire, David T. Tennant

It is certified that error appears in the above-identified patent and that said Letters Patent is hereby corrected as shown below:

Claim 10, Col. 13, line 54, "predetermine" should be --predetermined--.

Signed and Sealed this

Sixteenth Day of July, 1991

*Attest:*

*Attesting Officer*

HARRY F. MANBECK, JR.

*Commissioner of Patents and Trademarks*